US012508480B2

(12) United States Patent
Oldknow et al.

(10) Patent No.: US 12,508,480 B2
(45) Date of Patent: Dec. 30, 2025

(54) GOLF CLUBS AND GOLF CLUB HEADS HAVING INTERCHANGEABLE REAR BODY MEMBERS

(71) Applicant: KARSTEN MANUFACTURING CORPORATION, Phoenix, AZ (US)

(72) Inventors: Andrew G. v. Oldknow, Beaverton, OR (US); Robert M. Boyd, Flower Mound, TX (US); John T. Stites, Sallisaw, OK (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 48 days.

(21) Appl. No.: 18/513,370

(22) Filed: Nov. 17, 2023

(65) Prior Publication Data

US 2024/0082657 A1 Mar. 14, 2024

Related U.S. Application Data

(60) Division of application No. 17/454,223, filed on Nov. 9, 2021, now Pat. No. 11,865,415, which is a (Continued)

(51) Int. Cl.

| | |
|---|---|
| ***A63B 53/06*** | (2015.01) |
| ***A63B 53/04*** | (2015.01) |
| ***A63B 60/02*** | (2015.01) |

(52) U.S. Cl.

CPC ..... *A63B 53/0466* (2013.01); *A63B 53/04* (2013.01); *A63B 60/02* (2015.10); (Continued)

(58) Field of Classification Search

CPC ..... A63B 53/04; A63B 2053/0491; A63B 2053/0495

See application file for complete search history.

(56) References Cited

U.S. PATENT DOCUMENTS 690,996 A * 1/1902 Ransom ..... A63B 53/04 473/343
1,091,231 A * 3/1914 Millar ..... A63B 60/02 473/337

(Continued)

FOREIGN PATENT DOCUMENTS

CN 101970063 A * 2/2011 ..... A63B 53/0433
JP 62-268579 11/1987

(Continued)

OTHER PUBLICATIONS

International Preliminary Report on Patentability, dated Jun. 21, 2011, Search Report, dated Dec. 2, 2010, and Written Opinion, dated Jun. 18, 2011, from PCT Appl. No. PCT/US09/067430.

*Primary Examiner* — Alvin A Hunter

(57) ABSTRACT

Golf club heads (e.g. drivers, fairway woods, wood-type hybrid clubs, or the like) according to at least some example aspects of this invention include a striking face and a rear portion opposite the striking face, the rear portion defining an opening to an interior cavity. A rear body member configured to be inserted into the opening is engaged with the rear portion of the club head. The rear body member may include multiple rear body parts that may be removable and/or interchangeable to permit flexibility in controlling the weight distribution of the golf club head.

14 Claims, 15 Drawing Sheets

Related U.S. Application Data continuation of application No. 16/928,144, filed on Jul. 14, 2020, now Pat. No. 11,167,184, which is a continuation of application No. 16/428,788, filed on May 31, 2019, now Pat. No. 10,737,149, which is a continuation of application No. 14/643,637, filed on Mar. 10, 2015, now Pat. No. 10,322,321, which is a continuation of application No. 13/484,886, filed on May 31, 2012, now Pat. No. 9,072,949, which is a continuation-in-part of application No. 13/277,257, filed on Oct. 20, 2011, now Pat. No. 8,657,702, which is a continuation of application No. 12/338,487, filed on Dec. 18, 2008, now Pat. No. 8,043,167.

(52) U.S. Cl.
CPC ..... *A63B 53/0408* (2020.08); *A63B 53/0412* (2020.08); *A63B 2053/0491* (2013.01); *A63B 2209/00* (2013.01); *A63B 2209/02* (2013.01); *A63B 2209/023* (2013.01)

(56) References Cited

U.S. PATENT DOCUMENTS 1,167,106 A 1/1916 Palmer
1,167,387 A * 1/1916 Daniel ..... A63B 60/00 473/297
1,299,014 A * 4/1919 O'Hara ..... A63B 53/04 473/343
1,319,233 A * 10/1919 Mattern ..... A63B 53/0466 473/337
1,446,577 A * 2/1923 Nix ..... A63B 53/0466 473/337
1,452,695 A * 4/1923 Mattern ..... A63B 60/00 473/332
1,455,256 A * 5/1923 Kraeuter ..... A63B 60/00 473/343
1,455,379 A * 5/1923 Allen ..... A63B 53/04 473/337
1,483,614 A * 2/1924 Reach ..... A63B 60/00 473/343
1,504,326 A * 8/1924 Cullinan ..... A63B 53/04 473/343
1,528,017 A * 3/1925 Gammeter ..... A63B 53/04 144/24.24
1,534,600 A * 4/1925 Mattern ..... A63B 60/02 473/337
1,538,312 A * 5/1925 William ..... A63B 53/08 473/335
1,549,993 A * 8/1925 Klin ..... A63B 60/00 473/343
1,567,248 A * 12/1925 Dahlman ..... A63B 60/02 473/343
1,588,617 A * 6/1926 Newton ..... A63B 60/00 473/343
1,659,273 A * 2/1928 Link ..... A63B 53/04 473/343
1,659,274 A * 2/1928 Link ..... A63B 60/00 473/343
1,672,618 A * 6/1928 Link ..... A63B 53/0466 473/343
1,680,881 A * 8/1928 Heeter ..... A63B 53/0466 473/343
1,840,924 A * 1/1932 Tucker ..... A63B 53/047 473/337
1,942,434 A * 1/1934 Link ..... A63B 53/0466 473/343
3,064,980 A 11/1962 Steiner
3,220,733 A 11/1965 Saleeby
3,637,218 A * 1/1972 Carlino ..... A63B 53/02 473/330
3,817,534 A 6/1974 Carlino
3,979,123 A 9/1976 Belmont
4,811,949 A 3/1989 Kobayashi
4,811,950 A * 3/1989 Kobayashi ..... A63B 53/047 473/335
4,824,110 A * 4/1989 Kobayashi ..... A63B 60/00 473/347
4,852,880 A * 8/1989 Kobayashi ..... A63B 60/00 473/349
4,869,507 A * 9/1989 Sahm ..... A63B 53/047 473/337
4,883,274 A * 11/1989 Hsien ..... A63B 60/00 473/335
5,230,509 A 7/1993 Chavez
5,246,227 A * 9/1993 Sun ..... A63B 53/0487 273/DIG. 1
5,354,055 A * 10/1994 MacKeil ..... A63B 53/0466 473/345
5,421,577 A * 6/1995 Kobayashi ..... A63B 53/04 473/335
5,429,365 A * 7/1995 McKeighen ..... B22C 9/10 164/45
5,447,309 A * 9/1995 Vincent ..... A63B 53/04 473/335
5,518,243 A * 5/1996 Redman ..... A63B 53/04 473/334
5,547,427 A * 8/1996 Rigal ..... A63B 53/04 473/345
5,564,705 A * 10/1996 Kobayashi ..... A63B 60/00 473/349
5,584,770 A * 12/1996 Jensen ..... A63B 53/0466 473/345
5,624,331 A * 4/1997 Lo ..... A63B 53/0466 473/347
5,720,674 A * 2/1998 Galy ..... A63B 53/0466 473/335
5,755,627 A 5/1998 Yamazaki et al.
5,947,840 A * 9/1999 Ryan ..... A63B 53/0466 473/335
5,971,867 A * 10/1999 Galy ..... A63B 53/0466 473/335
6,012,990 A 1/2000 Nishizawa
6,017,280 A * 1/2000 Hubert ..... A63B 60/00 473/324
6,030,293 A 2/2000 Takeda
6,030,295 A * 2/2000 Takeda ..... A63B 60/00 473/335
6,080,068 A * 6/2000 Takeda ..... A63B 53/04 473/307
6,123,627 A * 9/2000 Antonious ..... A63B 60/00 473/328
6,162,133 A * 12/2000 Peterson ..... A63B 53/0466 473/345
6,217,461 B1 * 4/2001 Galy ..... A63B 60/00 473/328
6,290,608 B2 9/2001 Gates
6,299,547 B1 10/2001 Kosmatka
6,332,848 B1 * 12/2001 Long ..... A63B 53/0466 473/328
6,336,869 B1 * 1/2002 Hettinger ..... A63B 53/04 473/340
6,409,612 B1 * 6/2002 Evans ..... A63B 53/04 473/324
6,440,009 B1 * 8/2002 Guibaud ..... A63B 53/0466 473/349
6,458,044 B1 * 10/2002 Vincent ..... A63B 53/04 473/409
6,485,375 B1 * 11/2002 McKinley ..... A63B 60/02 473/340
6,524,197 B2 * 2/2003 Boone ..... A63B 53/0466 473/324
6,533,679 B1 * 3/2003 McCabe ..... A63B 60/02 473/335
6,558,271 B1 * 5/2003 Beach ..... A63B 60/00 473/334
6,565,452 B2 * 5/2003 Helmstetter ..... A63B 53/0466 473/324

(56) References Cited

U.S. PATENT DOCUMENTS 6,641,487 B1 11/2003 Hamburger
6,648,772 B2 11/2003 Vincent et al.
6,648,773 B1 * 11/2003 Evans ..... A63B 53/0466 473/345
6,739,983 B2 * 5/2004 Helmstetter ..... A63B 53/0466 473/335
RE38,605 E * 9/2004 Kubica ..... A63B 53/0466 473/314
6,860,818 B2 * 3/2005 Mahaffey ..... A63B 60/02 473/256
6,875,129 B2 4/2005 Erickson et al.
6,878,073 B2 4/2005 Takeda
6,890,267 B2 * 5/2005 Mahaffey ..... A63B 60/02 473/328
6,926,619 B2 * 8/2005 Helmstetter ..... A63B 53/02 473/345
6,942,580 B2 * 9/2005 Hou ..... A63B 53/047 473/332
6,955,612 B2 10/2005 Lu
6,962,538 B2 * 11/2005 Roach ..... A63B 53/047 473/332
6,988,960 B2 * 1/2006 Mahaffey ..... A63B 53/0466 473/345
6,991,558 B2 * 1/2006 Beach ..... A63B 60/00 473/324
7,004,852 B2 * 2/2006 Billings ..... A63B 53/06 473/332
7,056,228 B2 6/2006 Beach et al.
7,063,628 B2 * 6/2006 Reyes ..... A63B 60/02 473/324
7,077,763 B2 7/2006 Wahl et al.
7,083,530 B2 8/2006 Wahl et al.
7,108,611 B2 * 9/2006 MacIlraith ..... A63B 53/06 473/340
7,115,047 B2 * 10/2006 Stevens ..... A63B 53/0466 473/345
7,121,955 B2 * 10/2006 Stevens ..... A63B 53/0466 473/345
7,128,664 B2 * 10/2006 Onoda ..... A63B 53/0466 473/347
7,147,573 B2 * 12/2006 DiMarco ..... A63B 53/0466 473/335
7,153,220 B2 * 12/2006 Lo ..... A63B 60/00 473/340
7,163,468 B2 1/2007 Gibbs et al.
7,166,040 B2 1/2007 Hoffman et al.
7,166,041 B2 1/2007 Evans
7,175,541 B2 * 2/2007 Lo ..... A63B 53/0466 473/335
7,189,165 B2 * 3/2007 Yamamoto ..... A63B 53/0466 473/347
7,229,362 B2 * 6/2007 Tavares ..... A63B 53/0466 473/324
7,232,381 B2 * 6/2007 Imamoto ..... A63B 53/047 473/347
7,297,072 B2 * 11/2007 Meyer ..... A63B 60/00 473/332
7,303,487 B2 * 12/2007 Kumamoto ..... A63B 53/0466 473/345
7,316,623 B2 * 1/2008 Imamoto ..... A63B 53/047 473/332
7,351,161 B2 4/2008 Beach
7,371,191 B2 * 5/2008 Sugimoto ..... A63B 53/0466 473/345
7,396,299 B2 7/2008 Nicolette et al.
7,407,447 B2 8/2008 Beach et al.
7,412,517 B2 8/2008 Jorgensen
7,413,517 B2 * 8/2008 Butler, Jr. ..... A63B 53/04 473/330
7,419,441 B2 9/2008 Hoffman et al.
7,431,667 B2 * 10/2008 Vincent ..... A63B 53/0466 473/348
7,435,190 B2 * 10/2008 Sugimoto ..... A63B 53/0466 473/345
7,465,190 B2 12/2008 Henningsen
7,491,131 B2 * 2/2009 Vinton ..... A63B 60/02 473/340
7,491,135 B1 * 2/2009 Rollinson ..... A63B 60/54 473/342
7,540,810 B2 * 6/2009 Hettinger ..... A63B 53/0487 473/331
7,549,935 B2 6/2009 Foster et al.
7,588,502 B2 9/2009 Nishino
7,601,076 B2 * 10/2009 Rollinson ..... A63B 53/0487 473/340
7,611,424 B2 11/2009 Nagai et al.
7,628,711 B2 12/2009 Akinori et al.
7,628,713 B2 * 12/2009 Tavares ..... A63B 53/0466 473/348
7,632,193 B2 * 12/2009 Thielen ..... A63B 60/02 473/345
7,637,822 B2 * 12/2009 Foster ..... A63B 53/0466 473/335
7,662,051 B2 * 2/2010 Chen ..... A63B 53/047 473/350
7,713,143 B2 * 5/2010 Evans ..... A63B 53/06 473/335
7,785,212 B2 8/2010 Lukasiewicz, Jr. et al.
7,794,334 B2 * 9/2010 Hilton ..... A63B 53/0487 473/341
7,798,914 B2 * 9/2010 Noble ..... A63B 60/00 473/335
7,803,065 B2 * 9/2010 Breier ..... A63B 53/0466 473/335
7,806,782 B2 * 10/2010 Stites ..... A63B 53/0466 473/409
7,811,178 B2 * 10/2010 Davis ..... A63B 60/02 473/340
7,871,339 B2 * 1/2011 Sanchez ..... A63B 53/047 473/335
7,878,919 B2 2/2011 Perry et al.
7,927,231 B2 * 4/2011 Sato ..... A63B 53/06 473/336
7,959,522 B2 * 6/2011 North, III ..... A63B 53/0466 473/324
7,988,567 B2 8/2011 Kim et al.
7,988,568 B2 * 8/2011 Stites ..... A63B 53/047 473/334
7,988,658 B2 8/2011 Quinn
8,033,930 B2 * 10/2011 Tavares ..... A63B 60/00 473/345
8,043,167 B2 * 10/2011 Boyd ..... A63B 60/02 473/345
8,062,150 B2 * 11/2011 Gilbert ..... A63B 53/0475 473/332
8,062,151 B2 * 11/2011 Boyd ..... A63B 53/0466 473/345
8,133,128 B2 * 3/2012 Boyd ..... A63B 60/00 473/290
8,147,354 B2 * 4/2012 Hartwell ..... A63B 53/0466 473/344
8,182,362 B2 * 5/2012 Kusumoto ..... A63B 60/02 473/324
8,206,237 B2 * 6/2012 Gilbert ..... A63B 53/047 473/332
8,216,087 B2 * 7/2012 Breier ..... A63B 60/00 473/335
8,303,433 B2 * 11/2012 Roach ..... A63B 53/0466 473/335
8,357,057 B2 * 1/2013 Stites ..... A63B 53/06 473/345
8,435,137 B2 5/2013 Hirano
8,506,421 B2 * 8/2013 Stites ..... A63B 60/02 473/335
8,540,588 B2 * 9/2013 Rice ..... A63B 53/04 473/335
8,550,934 B2 * 10/2013 Evans ..... A63B 53/06 473/409

(56) References Cited

U.S. PATENT DOCUMENTS 8,579,724 B2 * 11/2013 Evans ..... A63B 60/00 473/349
8,608,589 B2 * 12/2013 Ferguson ..... A63B 53/0466 473/335
8,617,000 B2 * 12/2013 Ferguson ..... A63B 53/0466 473/335
8,657,702 B2 * 2/2014 Boyd ..... A63B 60/02 473/345
8,696,491 B1 * 4/2014 Myers ..... A63B 60/02 473/345
8,814,722 B2 * 8/2014 Stites ..... A63B 53/0466 473/334
8,858,362 B1 * 10/2014 Leposky ..... A63B 60/02 473/335
8,926,450 B2 * 1/2015 Takahashi ..... A63B 53/0466 473/347
8,956,244 B1 * 2/2015 Westrum ..... A63B 53/04 473/345
9,072,949 B2 * 7/2015 Stites ..... A63B 53/04
9,084,921 B1 * 7/2015 Liang ..... A63B 53/0466
9,168,435 B1 * 10/2015 Boggs ..... A63B 53/04
9,211,453 B1 * 12/2015 Foster ..... A63B 53/06
9,289,660 B1 * 3/2016 Myers ..... A63B 53/0466
9,375,624 B2 * 6/2016 Boyd ..... A63B 69/362
9,409,073 B2 * 8/2016 Boyd ..... A63B 69/362
9,421,432 B2 * 8/2016 Galvan ..... A63B 60/02
9,486,677 B1 * 11/2016 Seluga ..... A63B 53/0466
9,492,721 B2 * 11/2016 Ghods ..... A63B 53/0466
9,504,889 B2 * 11/2016 Mitzel ..... A63B 60/52
9,597,558 B1 * 3/2017 Seluga ..... A63B 53/0466
9,597,561 B1 * 3/2017 Seluga ..... A63B 60/52
9,687,701 B1 * 6/2017 Seluga ..... A63B 60/00
9,687,702 B1 * 6/2017 Seluga ..... A63B 53/0466
9,694,257 B1 * 7/2017 Seluga ..... A63B 60/00
9,707,456 B2 * 7/2017 Sanchez ..... A63B 53/0466
9,757,629 B2 * 9/2017 Seluga ..... A63B 53/0466
9,776,058 B2 * 10/2017 Seluga ..... A63B 53/04
9,795,845 B2 * 10/2017 Taylor ..... A63B 60/52
9,814,947 B1 * 11/2017 Seluga ..... A63B 53/0466
9,821,199 B1 * 11/2017 Seluga ..... A63B 60/50
9,889,349 B1 * 2/2018 Seluga ..... A63B 60/00
9,901,792 B2 * 2/2018 Franklin ..... A63B 53/047
9,908,013 B2 * 3/2018 Hettinger ..... A63B 53/0466
9,908,017 B2 * 3/2018 Seluga ..... A63B 53/0466
9,914,027 B1 * 3/2018 Harbert ..... A63B 60/00
9,931,550 B1 * 4/2018 Seluga ..... A63B 60/52
9,943,733 B2 * 4/2018 Franklin ..... A63B 53/04
9,987,527 B1 * 6/2018 Myers ..... A63B 53/0408
9,987,528 B2 * 6/2018 Bennett ..... A63B 53/04
9,999,813 B2 * 6/2018 Cleghorn ..... A63B 53/0466
10,086,239 B2 * 10/2018 Myrhum ..... A63B 60/52
10,213,661 B2 * 2/2019 Seluga ..... A63B 53/0466
10,238,933 B1 * 3/2019 Seluga ..... A63B 60/00
10,286,272 B2 * 5/2019 Ghods ..... A63B 60/52
10,322,321 B2 * 6/2019 Oldknow ..... A63B 53/0466
10,369,435 B1 * 8/2019 Myers ..... F16G 11/12
10,463,928 B2 * 11/2019 Stokke ..... A63B 53/06
10,569,143 B2 * 2/2020 Funaki ..... A63B 53/0466
10,695,628 B1 * 6/2020 Yi ..... A63B 53/08
10,737,149 B2 * 8/2020 Oldknow ..... A63B 53/06
11,167,184 B2 * 11/2021 Oldknow ..... A63B 53/045
11,865,415 B2 * 1/2024 Oldknow ..... A63B 53/0437
2001/0001302 A1 * 5/2001 Murphy ..... A63B 53/0466 473/345
2001/0049310 A1 * 12/2001 Cheng ..... A63B 60/00 473/345
2004/0176177 A1 * 9/2004 Mahaffey ..... A63B 60/02 473/334
2004/0224790 A1 * 11/2004 Lu ..... A63B 53/0466 473/345
2004/0229713 A1 * 11/2004 Helmstetter ..... A63B 53/04 473/345
2004/0242343 A1 * 12/2004 Chao ..... A63B 60/02 473/334
2004/0248665 A1 * 12/2004 Erickson ..... A63B 60/02 473/335
2005/0209021 A1 * 9/2005 Hoffman ..... A63B 53/0466 473/334
2005/0221911 A1 * 10/2005 Beach ..... A63B 53/0466 473/338
2005/0272527 A1 * 12/2005 Sugimoto ..... A63B 53/0466 473/345
2006/0014592 A1 * 1/2006 Sugimoto ..... A63B 53/0466 473/345
2006/0154747 A1 * 7/2006 Beach ..... A63B 60/02 473/345
2007/0149316 A1 * 6/2007 Nishino ..... A63B 60/02 473/335
2008/0039228 A1 * 2/2008 Breier ..... A63B 60/00 473/345
2009/0203465 A1 * 8/2009 Stites ..... A63B 53/0466 473/343
2009/0239681 A1 9/2009 Sugimoto
2010/0041494 A1 * 2/2010 Boyd ..... A63B 60/00 473/342
2010/0105499 A1 * 4/2010 Roach ..... A63B 53/04 473/335
2010/0160091 A1 * 6/2010 Boyd ..... A63B 53/0466 473/409
2010/0331102 A1 * 12/2010 Golden ..... A63B 53/04 473/345
2013/0040755 A1 * 2/2013 Stites ..... A63B 53/04 473/345
2013/0324299 A1 * 12/2013 Clausen ..... A63B 53/047 473/409
2019/0282868 A1 * 9/2019 Oldknow ..... A63B 53/0433

FOREIGN PATENT DOCUMENTS

JP 02180281 A * 7/1990 ..... A63B 53/0466
JP H02180281 7/1990
JP 03018379 A * 1/1991
JP 1991018379 1/1991
JP H03018380 1/1991
JP 04347179 A * 12/1992
JP H04347179 12/1992
JP 07-231957 9/1995
JP 08280854 A * 10/1996
JP H08280854 10/1996
JP 08308962 A * 11/1996
JP H08308962 11/1996
JP 09215786 A * 8/1997
JP H09215786 8/1997
JP 10263116 10/1998
JP 10263116 A * 10/1998
JP 10263122 A * 10/1998 ..... A63B 53/04
JP 10277186 10/1998
JP 10277186 A * 10/1998
JP H10263116 10/1998
JP H10277186 10/1998
JP 11114103 A * 4/1999
JP H11114103 4/1999
JP 11178955 A * 7/1999
JP H11178955 7/1999
JP 11-244433 9/1999
JP 2000014841 1/2000
JP 2001204856 1/2000
JP 2000126339 5/2000
JP 2000126339 A * 5/2000
JP 2001000606 1/2001
JP 2001025518 1/2001
JP 2001062013 3/2001
JP 2001204858 7/2001
JP 2001204858 A * 7/2001
JP 2004081241 3/2004
JP 2004135991 5/2004
JP 2004135991 A * 5/2004 ..... A63B 53/04
JP 2004159854 6/2004
JP 2004159854 A * 6/2004
JP 2005278838 A * 10/2005 ..... A63B 53/0433
JP 2005342244 A * 12/2005 ..... A63B 53/0466

(56) References Cited

FOREIGN PATENT DOCUMENTS

| | | | | | |
|---|---|---|---|---|---|
| JP | 2006101918 | A | * | 4/2006 | |
| JP | 2006239154 | | | 9/2006 | |
| JP | 2006288882 | | | 10/2006 | |
| JP | 2007083012 | | | 4/2007 | |
| JP | 2007167554 | A | * | 7/2007 | ..... A63B 53/0466 |
| JP | 2006101918 | | | 12/2007 | |
| JP | 2009226062 | A | * | 10/2009 | ..... A63B 53/047 |
| JP | 2010029677 | A | * | 2/2010 | ..... A63B 53/0466 |
| JP | 2010273804 | A | * | 12/2010 | ..... A63B 53/0466 |
| JP | 2010284538 | A | * | 12/2010 | ..... A63B 53/0466 |
| JP | 2014223548 | A | * | 12/2014 | ..... A63B 53/04 |
| WO | WO-2004007033 | A1 | * | 1/2004 | ..... A63B 53/0466 |
| WO | WO-2007076304 | A2 | * | 7/2007 | ..... A63B 53/04 |
| WO | WO-2009008563 | A1 | * | 1/2009 | ..... A63B 53/04 |
| WO | WO-2010019635 | A2 | * | 2/2010 | ..... A63B 53/04 |
| WO | WO-2010028114 | A2 | * | 3/2010 | ..... A63B 53/04 |

* cited by examiner

GOLF CLUBS AND GOLF CLUB HEADS HAVING INTERCHANGEABLE REAR BODY MEMBERS

CROSS REFERENCE TO RELATED APPLICATIONS

This is a division of U.S. patent application Ser. No. 17/454,223, filed on Nov. 9, 2021, which is a continuation of U.S. patent application Ser. No. 16/928,144, now U.S. Pat. No. 11,167,184, filed on Jul. 14, 2020, which is a continuation of U.S. patent application Ser. No. 16/428,788, now U.S. Pat. No. 10,737,149, filed on May 31, 2019, which is a continuation of U.S. patent application Ser. No. 14/643,637, now U.S. Pat. No. 10,322,321, filed on Mar. 10, 2015, which is a continuation of U.S. patent application Ser. No. 13/484,886, now U.S. Pat. No. 9,072,949, filed on May 31, 2012, which is a continuation-in-part of U.S. patent application Ser. No. 13/277,257, now U.S. Pat. No. 8,657,702, filed Oct. 20, 2011, which is a continuation of U.S. patent application Ser. No. 12/338,487, now U.S. Pat. No. 8,043,167, filed Dec. 18, 2008, the contents of which are fully incorporated herein by reference.

FIELD OF THE INVENTION

The present invention relates generally to golf clubs and golf club heads. Particular example aspects of this invention relate to golf clubs and golf club heads having multi-part interchangeable rear body members.

BACKGROUND

In recent years, golf club heads and golf clubs have been designed to improve a golfer's accuracy by assisting the golfer in squaring the club head face at impact with a golf ball. A number of golf club heads have at least some weight of the golf club head positioned so as to alter or control the location of the club head's center of gravity. The location of the center of gravity of the golf club head is one factor that determines whether a golf ball will be propelled in the intended direction. When the center of gravity is positioned behind the point of engagement on the contact surface, the golf ball follows a generally straight route. When the center of gravity is spaced to a side of the point of engagement, however, the golf ball may fly in an unintended direction and/or may follow a route that curves left or right, ball flights that often are referred to as "pulls," "pushes," "draws," "fades," "hooks," or "slices." Similarly, when the center of gravity is spaced above or below the point of engagement, the flight of the golf ball may exhibit more boring or climbing trajectories, respectively.

While the industry has witnessed dramatic changes and improvements to golf equipment in recent years, some players continue to experience difficulties in reliably hitting a golf ball in an intended and desired direction and/or with an intended and desired flight path. This is particularly true for clubs used to hit the ball long distances, such as drivers and woods. Accordingly, there is room in the art for further advances in golf club technology.

SUMMARY OF THE INVENTION

Golf club heads, and particularly wood-type golf club heads (e.g., drivers, fairway woods, wood-type hybrid clubs, or the like), according to at least some example aspects of this invention include: (a) a club head body made from one or more parts, wherein the club head body includes a heel portion, a toe portion, a top portion, a sole portion, a striking face, and a rear portion opposite the striking face, wherein the club head body defines an interior cavity, and wherein the rear portion defines at least a first opening to the interior cavity; and (b) a rear body made from one or more parts, wherein the rear body is releasably engaged with the club head body and is configured to at least partially cover the first opening. The rear body member may be releasably engaged with the rear face and/or other portion of the club head body.

Additional aspects of this invention relate to golf club structures that include golf club heads, e.g., of the types described above. Such golf club structures further may include one or more of: a shaft member attached to the club head (optionally via a separate hosel member or a hosel member provided as an integral part of one or more of the club head or shaft); a grip or handle member attached to the shaft member; additional weight members; etc.

Still additional aspects of this invention relate to methods for making golf club heads and golf club structures in accordance with examples of this invention. Such methods may include, for example: (a) providing a golf club head or club head body of the various types described above, e.g., by manufacturing or otherwise making the golf club head, by obtaining the golf club head from another source, etc.; (b) engaging a shaft member with the golf club head; (c) engaging a grip member with the shaft member; (d) engaging a weight member with the golf club head; and/or (e) engaging a rear body member with the rear portion and/or other portion of the club head body or club structure; etc.

Still other aspects of this invention relate to golf clubs and golf club heads having a rear body member formed of at least two rear body parts. The at least two rear body parts may have equal or substantially equal weight, weight distribution, density, size, shape, and/or other characteristics, or each of the at least two rear body parts may have different weights, weight distributions, densities, sizes, shapes, and/or other characteristics. In some arrangements, the rear body member may include three or more rear body parts, thereby permitting additional flexibility in the weight distribution associated with the rear body member.

BRIEF DESCRIPTION OF THE DRAWINGS

The present invention is illustrated by way of example and not limited in the accompanying figures, m which like reference numerals indicate similar elements throughout, and in which.

Figure 1A:
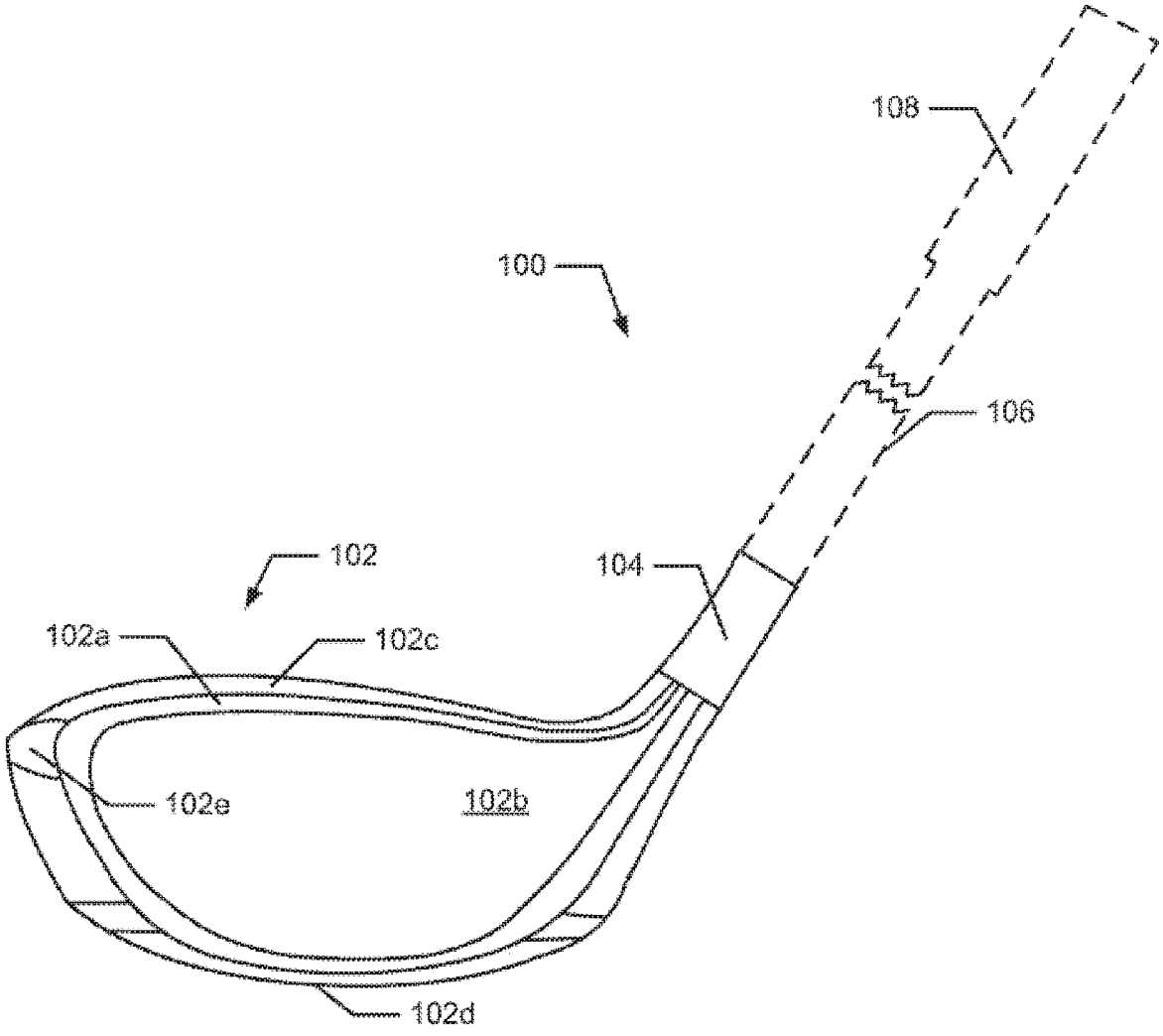
FIGS. 1A and 1B generally illustrate features of club head structures according to at least some examples of this invention.

The reader is advised that the various parts shown in these drawings are not necessarily drawn to scale.

DETAILED DESCRIPTION

The following description and the accompanying figures disclose features of golf club heads and golf clubs in accordance with examples of the present invention.

I. GENERAL DESCRIPTION OF EXAMPLE GOLF CLUB HEADS, GOLF CLUBS, AND METHODS IN ACCORDANCE WITH THIS INVENTION

Aspects of this invention relate to golf club heads and golf clubs including such club heads (e.g., drivers, fairway woods, wood-type hybrid clubs, or the like). Golf club heads according to at least some aspects of this invention may include: (a) a club head body made from one or more parts, wherein the club head body includes a heel portion, a toe portion, a top portion, a sole portion, a striking face, and a rear portion opposite the striking face, wherein the club head body defines an interior cavity, and wherein the rear portion defines at least a first opening to the interior cavity; and (b) a rear body made from one or more parts, wherein the rear body is releasably engaged with the club head body and is configured to at least partially cover the first opening. The rear body may be releasably engaged with the club head body (e.g., the rear portion and/or other portion(s) of the club head body). Any desired portion of the rear body member may be engaged with the club head body. In some embodiments, a portion of the rear body member may extend into a cavity defined in the club head body (e.g., at least some portion, all, or at least a major portion of the rear body member may be located within the rear body member receiving cavity). In other embodiments, at least a portion of the rear body member may extend beyond the exterior perimeter surface of the rear portion of the club head body. Additionally, if desired, the rear body member may form at least a portion of the golf club head's crown and or sole when attached to the main club head body. Alternatively, in some embodiments, the rear body member will not form any portion of the crown and or sole. Using different releasably engageable rear body members may allow for the modification of the overall size, shape, weight, weight distribution, center of gravity, moment of inertia and/or other characteristics of the golf club head. In certain aspects of the invention, the rear body member may provide an overall conventionally shaped golf club head (e.g., having a rounded rear perimeter portion) while, in other embodiments, the rear body member may provide a more modem club head appearance (e.g., having rear and/or side portions that provide a more square or rectangular overall club head shape).

The rear body receiving cavity, when present, may be provided at any desired location(s) in the rear portion of the club head body without departing from this invention. In some examples, the opening to this rear body receiving cavity may extend beyond the rear portion to the sole and/or the crown of the club head body. Additionally or alternatively, the rear body receiving cavity may extend beyond the rear portion of the club head body to the heel and/or toe portions of the club head body. In some embodiments, the rear body receiving cavity may have a depth of at least 5 millimeters, at least 7 millimeters, or at least 10 millimeters at its deepest location. Additionally, the cross-section of the cavity may be of many shapes including, in some embodiments, cross-sections that are square, rectangular, hemispherical, trapezoidal, etc. One or more rear body receiving cavities and/or one or more rear bodies may be provided in an overall golf club head structure without departing from this invention.

The club head body also may include one or more openings to its interior cavity. In embodiments of the invention with multiple openings, the multiple openings may be substantially adjacent to each other or they may be separated by solid portions of the rear portion of the club head body. In certain aspects of the invention, the golf club head may include multiple rear body members or a rear body member comprised of multiple parts or portions. In some embodiments, the golf club head may include at least two rear body members or at least three body members. The opening(s) to the interior cavity may be located and/or arranged anywhere along the rear portion of the club head body without departing from this invention.

The club head body also may take on a variety of forms without departing from this invention. For example, the club head body may be made from any desired number of different parts, of any desired construction, from any desired materials, etc., without departing from this invention, including from conventional parts, of conventional constructions, and/or from conventional materials as are known and used in the art. In some example structures, the club head body will include one or more of the following parts: a crown, a sole, a face member (optionally including a ball striking face integrally formed therein or attached thereto), one or more body members (e.g., forming or defining the periphery of the club head between the crown and sole), a sole plate, a frame member (optionally of metal, such as titanium alloys or the like, e.g., forming or defining the periphery of the club head between the crown and sole and/or to which one or more of the crown and/or the sole (if present) are engaged, etc.), an aft body, etc. The club head body may include: one or more metal or metal alloy parts (e.g., a frame, optionally including or engaged with the ball striking face, a face member, etc.), such as stainless steel, titanium or titanium alloys, aluminum or aluminum alloys, magnesium or magnesium alloys, etc.; polymeric materials (e.g., for the crown or sole, for the club head body portions between the crown and sole, for the face member, etc.); composite materials, including fiber or particle reinforced composite materials, such as carbon fiber composite materials, basalt fiber composite materials, fiberglass materials, etc. (e.g., for the crown or sole, for the club head body portions between the crown and sole, for the face member, etc.); etc. Any desired structure and/or arrangement of the club head body structure and/or its various parts may be used without departing from this invention.

Also, any desired construction for the rear body member may be used without departing from the invention. If desired, the rear body member may be releasably engaged with the rear portion and/or other portion of the golf club head in any desired manner without departing from this invention, including through the use of mechanical connectors, retaining member structures, spring-loaded connectors and/or retaining structures, and the like. More specific examples of rear body members and their engagement with the remainder of a club head body are described below.

Additional aspects of this invention relate to golf club structures that include golf club heads, e.g., of the types described above. Such golf club structures further may include one or more of: a shaft member attached to the club head (optionally via a separate hosel member or a hosel member provided as a part of one or more of the club head and/or shaft); a grip or handle member attached to the shaft member; an additional weight member attached to one or more of the club head body, shaft, or grip; multiple rear body members; etc.

Still additional aspects of this invention relate to methods for making golf club heads and golf club structures in accordance with examples of this invention. Such methods may include, for example: (a) providing a golf club head of the various types described above (including any or all of the various structures, features, and/or arrangements described above), e.g., by manufacturing or otherwise making the golf club head, by obtaining it from a third party source, etc.; (b) engaging a shaft member with the golf club head; (c) engaging a grip member with the shaft member; (d) engaging different rear bodies or rear body members with the club head body; etc.

Additional aspects of this invention relate to methods of using golf club heads, e.g., of the various types described above. Such methods may include, for example, securing the rear body member at various positions and/or orientations along the club head body, e.g., the central rear portion, the toe portion, the heel portion, etc.; removing the rear body member from the club head body; placing a new rear body member (or a new portion thereof) on the club head body; etc. In this manner, golf clubs and golf club heads in accordance with examples of this invention may be customized, e.g., to better fit or conform to a specific user's swing characteristics, to help correct or compensate for various swing flaws (e.g., to correct hooks, slices, etc.), to bias a club for specific types of ball flights (e.g., a draw bias, a fade bias, a low flight bias, a high flight bias, etc.), and the like. Golf club heads and/or golf clubs according to at least some examples of the invention also may be used by club fitters to find desired or optimal weighting characteristics for specific users, and if desired, such characteristics may be used in selecting parts, arranging weights, and/or weighting for a final, permanently weighted club structure.

Still other aspects of the invention relate to golf club heads including a club head body formed from one or more parts. In some examples, the club head body may include a heel region, a toe edge, a sole portion, a striking face, and a rear portion opposite the striking face. The club head body may, in some arrangements, define at least a first opening to an interior cavity. The golf club head may further include a rear body member connected to the rear portion of the club head body at the first opening to the interior cavity. The rear body member may, in some examples, include a first rear body portion connected to the club head body in the rear portion. In some arrangements, the first rear body portion has a first weight. The rear body member may further include a second rear body portion connected to the club head body in the rear portion. In at least some examples, the second rear body portion has a second weight different from the first weight.

Additional aspects of the invention relate to golf club heads including a club head body formed from one or more parts, the club head body including a heel region, a toe edge, a sole portion, a striking face, and a rear portion opposite the striking face. In some examples, the golf club head may further include a rear body member connected to the rear portion of the club head body. The rear body member may, in some arrangements, extend beyond a perimeter of the club head body. The rear body member may include a first rear body portion connected to the rear portion along or near the toe edge of the club head body, and a second rear body portion connected to the rear portion in the heel region of the club head body.

Still additional aspects of the invention relate to golf clubs including a shaft and a golf club head connected to a first end of the shaft. In at least some examples, the golf club head may include a club head body having a toe edge, a heel region, a ball striking face and a rear portion opposite the ball striking face. In some arrangements, the club head body may form a first club head footprint. The golf club may further include a rear body member connected to the rear portion of the club head body, the rear body member enlarging the first club head footprint.

Given the general description of various example aspects of the invention provided above, more detailed descriptions of various specific examples of golf clubs and golf club head structures according to the invention are provided below.

II. DETAILED DESCRIPTION OF EXAMPLE GOLF CLUB HEADS, GOLF CLUB STRUCTURES, AND METHODS ACCORDING TO THE INVENTION

The following discussion and accompanying figures describe various example golf clubs and golf club head structures in accordance with the present invention. When the same reference number appears in more than one drawing, that reference number is used consistently in this specification and the drawings to refer to the same or similar parts throughout.

Example golf club and golf club head structures in accordance with this invention may constitute "wood-type" golf clubs and golf club heads, e.g., clubs and club heads typically used for drivers and fairway woods, as well as for "wood-type" utility or hybrid clubs, or the like. Such club head structures may have little or no actual "wood" material and still may be referred to conventionally in the art as "woods" (e.g., "metal woods," "fairway woods," etc.). The club heads may include a multiple piece construction and structure, e.g., including one or more of a sole member, a face member (optionally including a ball striking face integrally formed therein or attached thereto), one or more body members (e.g., material extending around the perimeter and making up the club head body), a crown member, a face plate, a face frame member (to which a ball striking face may be attached), an aft body, etc. If desired, various portions of the club head structure may be integrally formed with one another, as a unitary, one piece construction, without departing from the invention (e.g., the body member(s) may be integrally formed with the sole and/or crown members, the face member may be integrally formed with the sole, body, and/or crown members, etc.). Optionally, if desired, the various portions of the club head structure (such as the sole member, the crown member, the face member, the body member(s), etc.) individually may be formed from multiple pieces of material without departing from this invention (e.g., a multi-piece crown, a multi-piece sole, etc.). Also, as other alternatives, if desired, the entire club head may be made as a single, one piece, unitary construction, or a face plate member may be attached to a one piece club head aft body (optionally, a hollow body, etc.). More specific examples and features of golf club heads and golf club structures according to this invention will be described in detail below in conjunction with the example golf club structures illustrated in FIGS. 1 through 6.

Figure 1B:
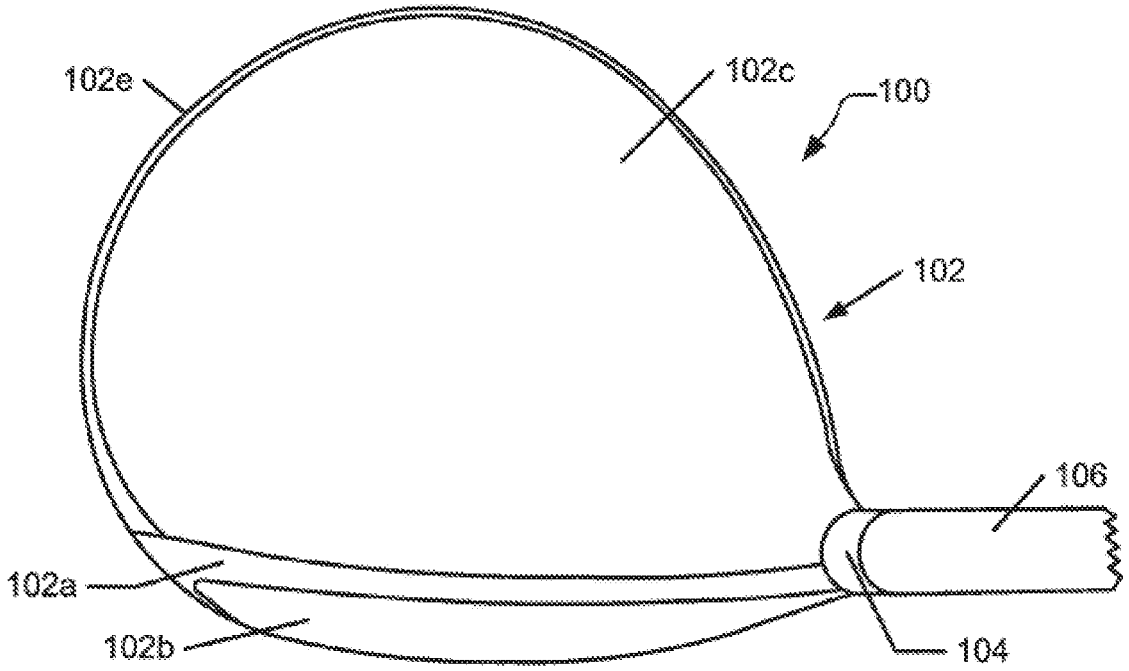

FIGS. 1A and 1B generally illustrate an example golf club 100 and/or golf club head 102 in accordance with this invention. In addition to the golf club head 102, the overall golf club structure 100 of this example includes a hosel region 104, a shaft member 106 received in and/or inserted into and/or through the hosel region 104, and a grip or handle member 108 attached to the shaft member 106. Optionally, if desired, the external hosel region 104 may be eliminated and the shaft member 106 may be directly inserted into and/or otherwise attached to the head member 102 (e.g., through an opening provided in the top of the club head 102, through an internal hosel member (e.g., provided within an interior chamber defined by the club head 102), etc.).

The shaft member 106 may be received in, engaged with, and/or attached to the club head 102 in any suitable or desired manner, including in conventional manners known and used in the art, without departing from the invention. As more specific examples, the shaft member 106 may be engaged with the club head 102 via a hosel member 104 and/or directly to the club head structure 102, e.g., via adhesives, cements, welding, soldering, mechanical connectors (such as threads, retaining elements, or the like), etc.; through a shaft-receiving sleeve or element extending into the club head body 102; etc. In some examples, the club head/shaft connection may include an "off-axis" or angled bore hole or interior chamber in which the shaft 106 (optionally a straight shaft) is received. More specifically, an outer cylindrical surface of the connection member may extend in a first axial direction, and an interior cylindrical surface of the bore hole may extend in a second axial direction that differs from the first axial direction. In this manner, while the shaft connection member exterior maintains a constant axial direction corresponding to that of the interior of the club head hosel and its opening, the shaft 106 extends away from the club head 102 at a different and, in some examples, adjustable angle with respect to the club head 102 and its ball striking face. Additional aspects of this off-axis arrangement are described in U.S. application Ser. No. 11/846,370 filed Aug. 28, 2007 and entitled "Releasable and Interchangeable Connections for Golf Club Heads and Shafts," which is incorporated herein by reference in its entirety. Other releasable and/or adjustable golf club head and shaft connection structures and assemblies may be used without departing from this invention.

The shaft member 106 also may be made from any suitable or desired materials, including conventional materials known and used in the art, such as graphite based materials, composite or other non-metal materials, steel materials (including stainless steel), aluminum materials, other metal alloy materials, polymeric materials, combinations of various materials, and the like. Also, the grip or handle member 108 may be attached to, engaged with, and/or extend from the shaft member 106 in any suitable or desired manner, including in conventional manners known and used in the art, e.g., using adhesives or cements; via welding, soldering, adhesives, or the like; via mechanical connectors (such as threads, retaining elements, etc.), including releasable mechanical connectors; etc. As another example, if desired, the grip or handle member 108 may be integrally formed as a unitary, one-piece construction with the shaft member 106. Additionally, any desired grip or handle member 108 materials may be used without departing from this invention, including, for example: rubber materials, leather materials, rubber or other materials including cord or other fabric material embedded therein, polymeric materials, and the like.

The club head 102 itself also may be constructed in any suitable or desired manner and/or from any suitable or desired materials without departing from this invention, including from conventional materials and/or in conventional manners known and used in the art. For example, in the example structure 102 shown in Figures IA and 1B, the club head 102 includes a ball striking face member 102*a* (optionally including a ball striking face plate 102*b* integrally formed with the face member 102*a* or attached to club such that the face plate 102*b* and a frame member together constitute the overall face member 102*a*). The club head 102 of this illustrated example further includes a crown 102*c*, a sole 102*d*, and at least one body portion 102*e* located between the crown or top portion 102*c* and the sole 102*d* (e.g., material extending from the face member 102*a*, around the club head periphery from the heel to the toe). This body portion 102*e*, which extends to a location substantially opposite the striking face, may include a rear portion of the club head structure.

A wide variety of overall club head constructions are possible without departing from this invention. For example, if desired, some or all of the various individual parts of the club head 102 described above may be made from multiple pieces that are connected together (e.g., by welding, adhesives, or other fusing techniques; by mechanical connectors; etc.). The various parts (e.g., crown 102*c*, sole 102*d*, and/or body portion(s) 102*e*) may be made from any desired materials and combinations of different materials, including materials that are conventionally known and used in the art, such as metal materials, including lightweight metal materials. More specific examples of suitable lightweight metal materials include steel, titanium and titanium alloys, aluminum and aluminum alloys, magnesium and magnesium alloys, etc.

As additional examples or alternatives, in order to reduce the club head 102 weight, if desired, one or more portions of the club head structure 102 advantageously may be made from a composite material, such as from carbon fiber composite materials that are conventionally known and used in the art. Other suitable composite or other non-metal materials that may be used for one or more portions of the club head structure 102 include, for example: fiberglass composite materials, basalt fiber composite materials, polymer materials, etc. As some more specific examples, if desired, at least some portion(s) of the crown member 102*c* may be made from composite or other non-metal materials. Additionally or alternatively, if desired, at least some portion(s) of the sole member 102*d* may be made from composite or other non-metal materials. As still additional examples or alternatives, if desired, one or more portions of the club head's body member 102*e* (the region of material extending between the crown 102*c* and the sole 102*d*) may be made from composite or other non-metal materials. As yet further examples, if desired, the entire body portion of the club head aft of a club head face member 102*a* (also called an "aft body"), or optionally the entire club head, may be made from composite or other non-metal materials without departing from this invention. The composite or other non-metal material(s) may be incorporated as part of the club head structure 102 in any desired manner, including in conventional manners that are known and used in the art. Reducing the club head's weight (e.g., through the use of composite or other non-metal materials, lightweight metals, metallic foam or other cellular structured materials, etc.) allows club designers and/or club fitters to selectively position additional weight in the overall club head structure 102, e.g., to desirable locations to increase the moment of inertia, affect the center of gravity location, and/or affect other playability characteristics of the club head structure 102 (e.g., to draw or fade bias a club head; to help get shots airborne by providing a low center of gravity; to help produce a lower, more boring ball flight; to help correct or compensate for swing flaws that produce undesired ball flights, such as hooks or slices, ballooning shots, etc.; etc.).

The various individual parts that make up a club head structure 102, if made from multiple pieces, may be engaged with one another and/or held together in any suitable or desired manner, including in conventional manners known and used in the art. For example, the various parts of the club head structure 102, such as the face member 102*a*, the ball striking plate 102*b*, the crown 102*c*, the sole 102*d*, and/or the body portion(s) 102*e* may be joined and/or fixed together (directly or indirectly through intermediate members) by adhesives, cements, welding, soldering, or other bonding or fusing techniques; by mechanical connectors (such as threads, screws, nuts, bolts, or other connectors); and the like. If desired, the mating edges of various parts of the club head structure 102 (e.g., the edges where members 102*a*, 102*b*, 102*c*, 102*d*, and/or 102*e* contact and join to one another) may include one or more raised ribs, tabs, ledges, or other engagement elements that fit into or onto corresponding grooves, slots, surfaces, ledges, openings, or other structures provided in or on the facing side edge to which it is joined. Cements, adhesives, mechanical connectors, finishing material, or the like may be used in combination with the raised rib/groove/ledge/edge or other connecting structures described above to further help secure the various parts of the club head structure 102 together.

The dimensions and/or other characteristics of a golf club head structure according to examples of this invention may vary significantly without departing from the invention. As some more specific examples, club heads in accordance with at least some examples of this invention may have dimensions and/or other characteristics that fall within the various example ranges of dimensions and/or characteristics of the club heads described in U.S. patent application Ser. No. 11/125,327 filed May 10, 2005 (and corresponding to U.S. Published Patent Appln. No. 2005-0239576 A1 published Oct. 27, 2005). Note, for example, the Tables in these documents. This U.S. patent publication is entirely incorporated herein by reference. In accordance with at least some example club head structures according to this invention, the ratio of the breadth dimension (i.e., overall dimension "B" in the front to back direction) to length dimension (i.e., overall dimension "L" from in the heel to toe direction) (i.e., ratio "B/L") will be at least 0.9, and in some examples, this ratio may be at least 0.92, at least 0.93, at least 0.94, at least 0.95, at least 0.96, at least 0.97, or even at least 0.98. The length dimension L may be at least 4 inches, and in some examples, at least 4.25 inches, at least 4.5 inches, at least 4.75 inches, or even at least 4.85 inches. The club head may have any desired volume, including, for example, a volume of at least 200 cc, and in some examples at least 350 cc, at least 400 cc, at least 420 cc, or even at least 450 cc.

FIGS. 2A through 2E illustrate additional example features and structures that may be included in golf club 100 and golf club head 102 structures in accordance with this invention. As shown in these figures, the rear portion 102*e* of this club head structure 102 includes an opening 210 to the interior cavity of the hollow club head 102 structure. In certain embodiments, the opening 210 may extend into a portion of the crown 102*c* and/or a portion of the sole 102*d* and/or the opening 210 may extend into the heel and/or toe portions of the club head structure 102. The opening 210 may be of any desired shape and or size, e.g., depending upon the desired characteristics of the club head 102 structure and placement of the rear body member (which will be described in more detail below); the size, dimensions and shape of the opening(s) may not necessarily be defined by the size, dimensions or shape of the cavity. For example, in some embodiments, the opening(s) may extend at least 10% of the perimeter of the length of the cavity, at least 25% of the perimeter of the length of the cavity, at least 50% of the perimeter of the length of the cavity, or even 100% of the perimeter of the length of the cavity. Similarly, in some embodiments, the opening(s) may extend at least 10% of the perimeter of the width of the cavity, at least 25% of the perimeter of the width of the cavity, at least 50% of the perimeter of the width of the cavity, or even 100% of the perimeter of the width of the cavity.

The savings in weight of the club head 102 structure by having a cavity and/or opening 210 may provide certain advantages for modifying club head characteristics. Some advantages may include the ability to use the weight savings to distribute additional weight at selected other locations in the club head 102 structure and the ability to visually access and inspect the interior of the club head 102. In some embodiments, strategic placement of weight in certain locations on the rear body (or other locations in the club structure) may be used to bias the club to launch balls with a preselected flight trajectory, such as a fading flight pattern, a drawing flight pattern, a higher trajectory flight pattern, a lower trajectory flight pattern, etc.

Figure 2A:
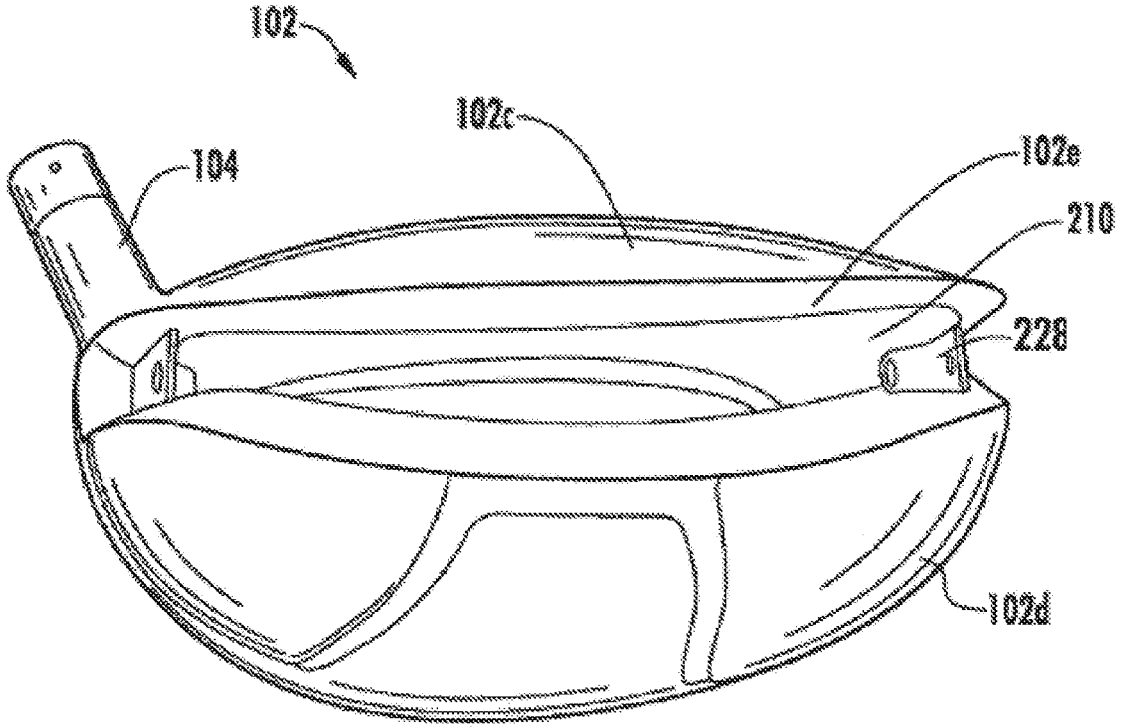
FIGS. 2A through 2E illustrate example golf club head structures in accordance with at least some examples of this invention.
Figure 2B:
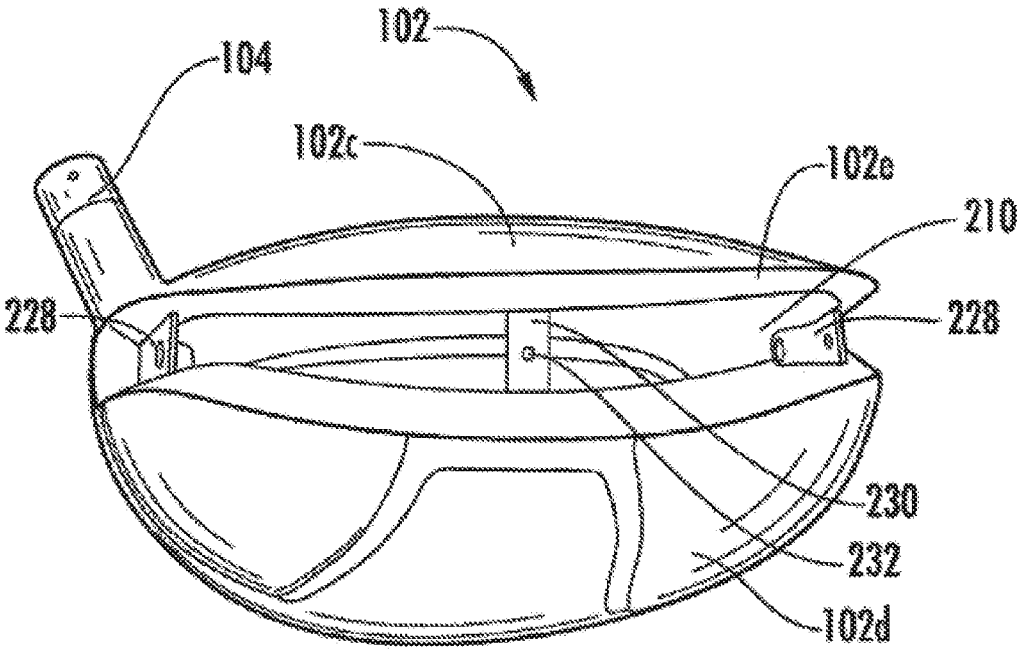
Figure 2C:
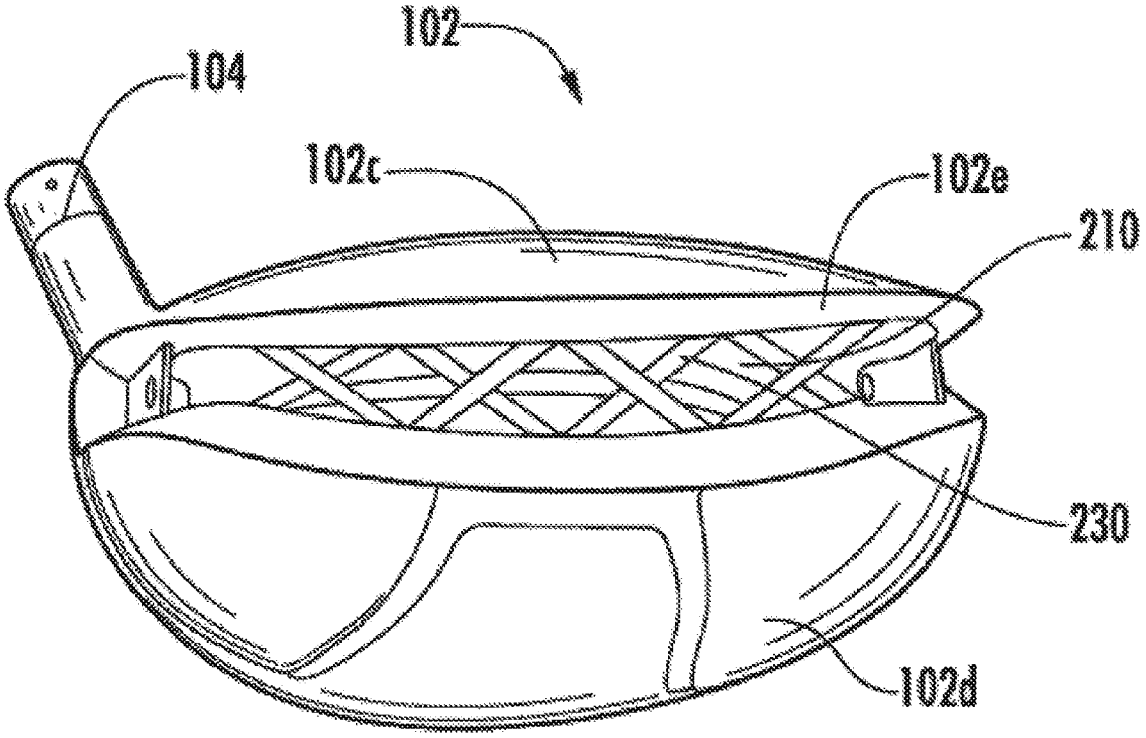

In alternative embodiments, as shown in FIGS. 2B and 2C, the cavity may include one or more support beams 230 or struts extending across the opening to the interior cavity of the club head. These beams 230 may provide additional support for the rear or crown of the club and/or provide additional or alternative mounting locations for mounting the rear body member(s) to the remainder of the club head 102 structure. As seen in one embodiment depicted in FIG. 2B, the club head 102 may include a substantially vertical beam 230 having a threaded opening 232 to receive a threaded connector (e.g., a screw or bolt) that may secure the rear body member to the remainder of the club head 102. Another embodiment, depicted in FIG. 2C, may include plural diagonally arranged beams 230 that extend across the cavity providing a lattice or web construction appearance. Other arrangements of beams 230 are possible without departing from this invention.

Figure 2D:
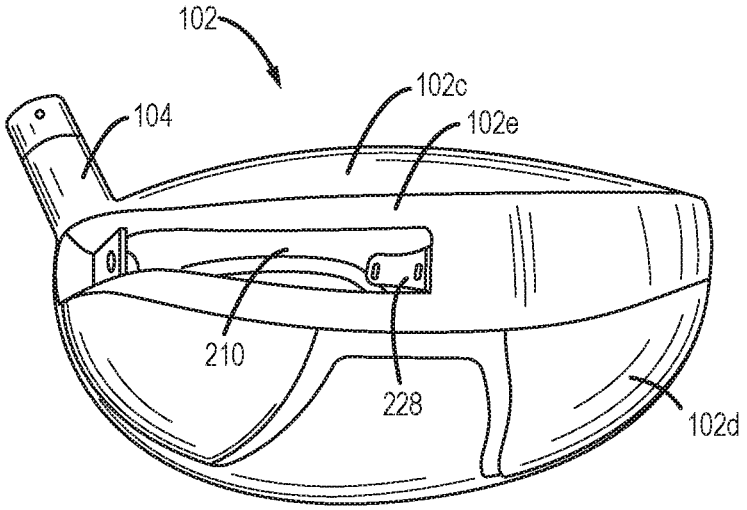
Figure 2E:
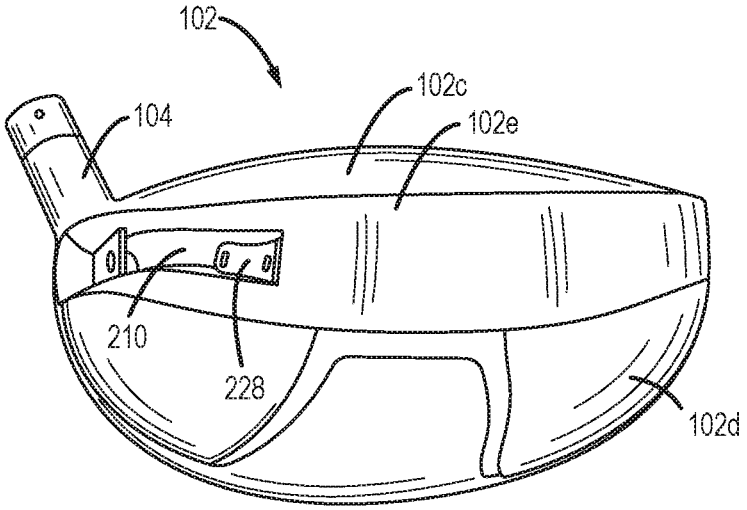

While FIGS. 2A through 2C illustrate the opening to the interior cavity of the club head in the center of club head 102 rear portion 102*e*, if desired, as shown in FIGS. 2D and 2E, the opening to the interior cavity may be offset, e.g., located more toward the heel side or the toe side, and/or plural openings (e.g., one in the heel area and one in the toe area) to the interior cavity may be provided on a club head 102 structure without departing from this invention. The opening to the interior cavity also may be angled along the rear face 102*e* (e.g., in a direction from the front heel toward the rear toe, in a direction from the front toe toward the rear heel, etc.) without departing from this invention.

Figure 3A:
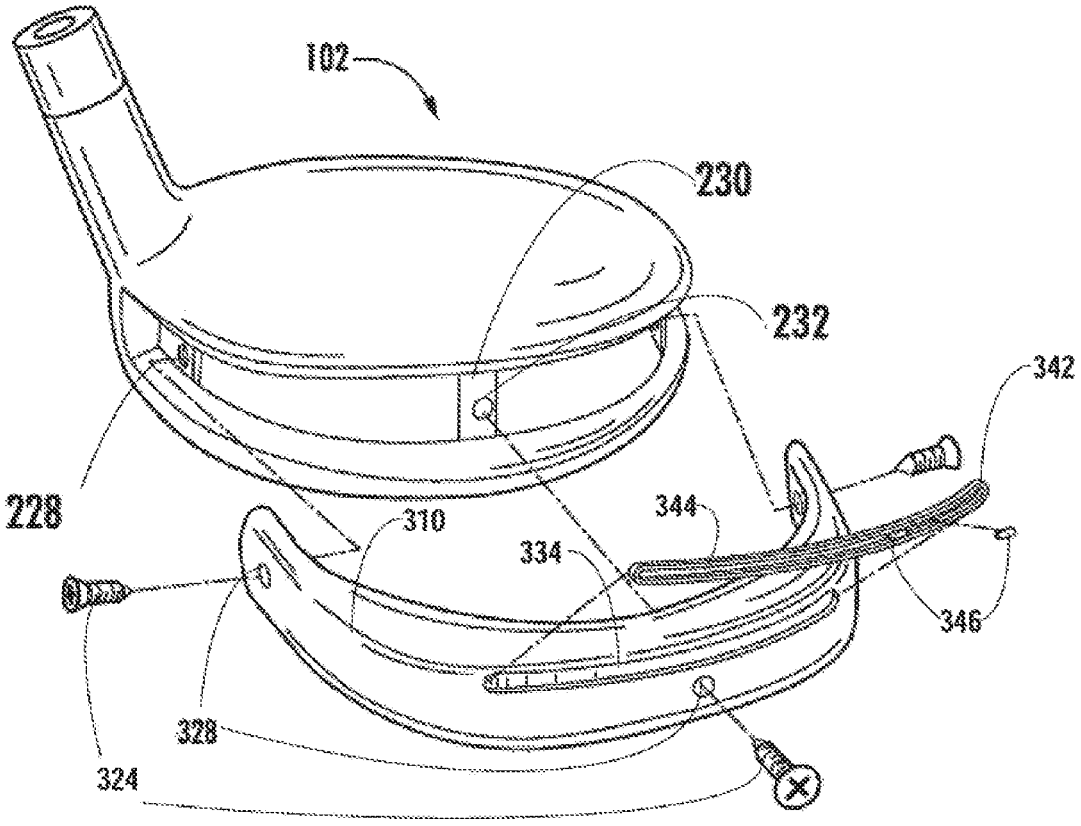
FIGS. 3A through 3C illustrate example rear body members in accordance with at least some examples of this invention.
Figure 3B:
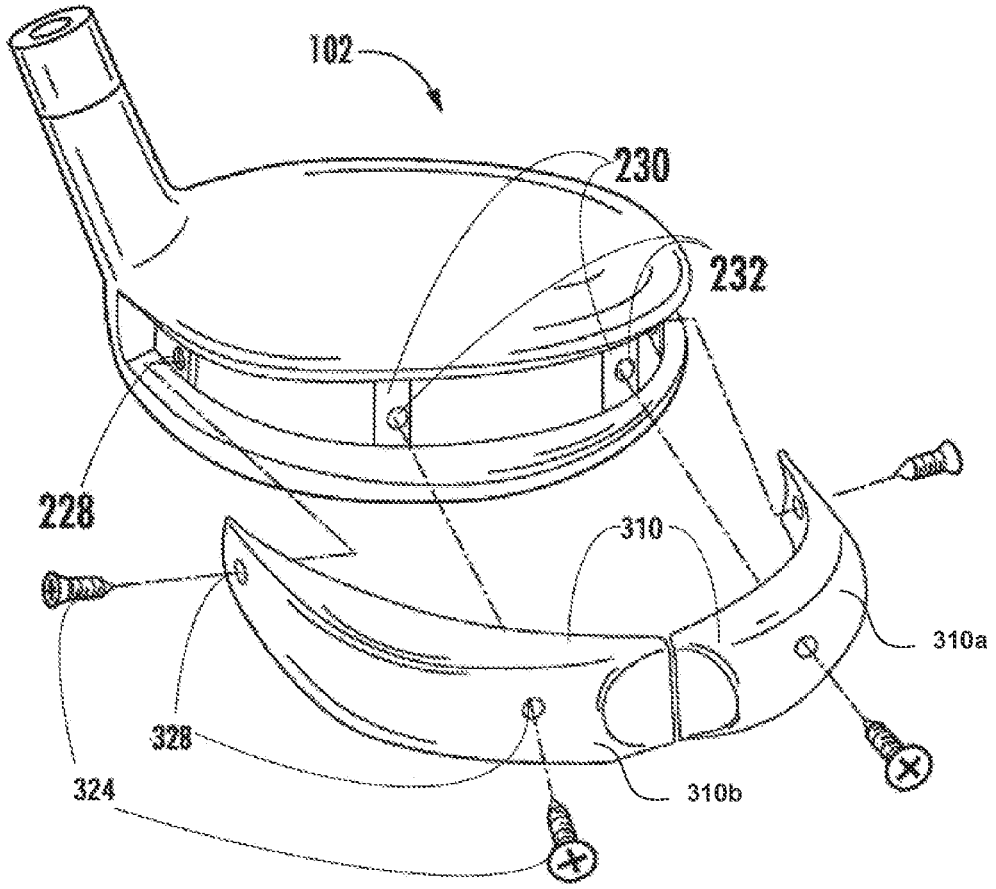
Figure 3C:
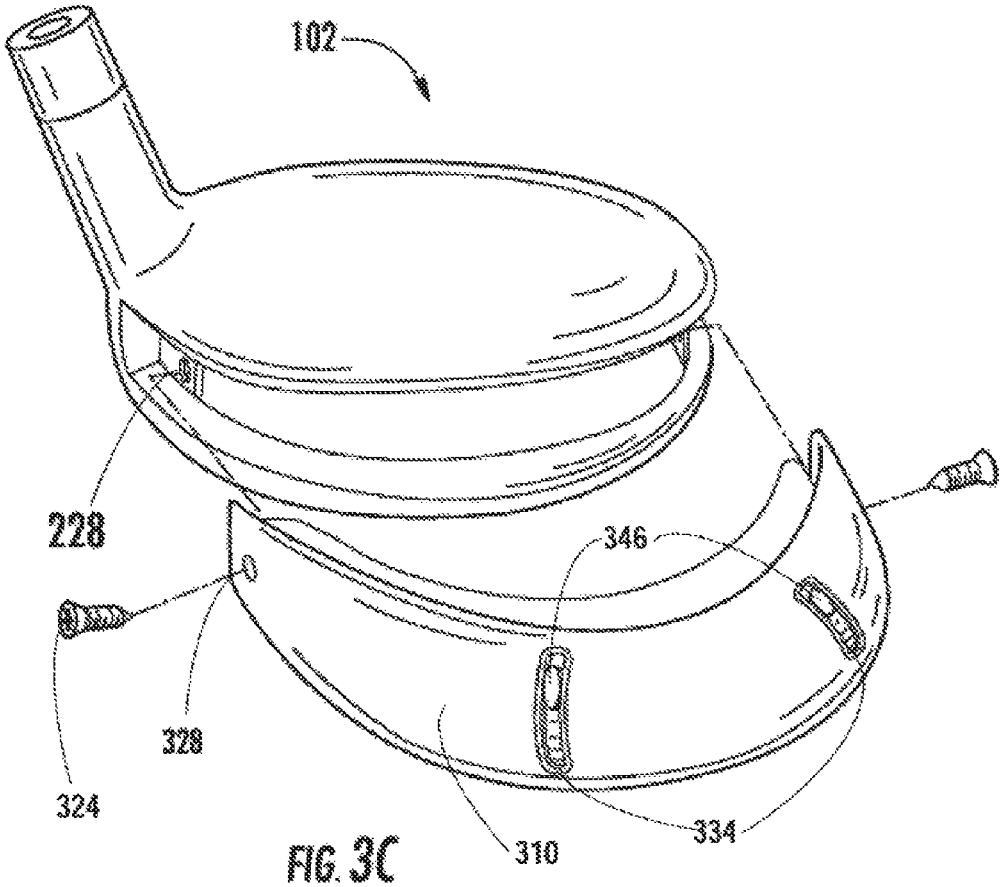

FIGS. 3A through 3C illustrate embodiments of a rear body member 310 in accordance with this invention and/or various portions thereof (including an example construction of such a club head 102). The rear body member 310 may be secured to the remainder of the club head 102 structure in a variety of ways. In the illustrated examples, one or more screw or bolt members 324 are provided to secure the rear body member 310 to the remainder of the club head 102 structure. Mounting holes 328 (optionally threaded) are defined on the rear body member 310 in this illustrated example, and screw or bolt members 324 may be arranged to engage holes 228 in the remainder of the club head 102 structure (optionally threaded) through these holes 328 to thereby hold the rear body member 310 in place with respect to the remainder of the club head 102 structure. If desired, the exposed head of screw or bolt member 324 may fit into a countersink opening provided in the rear body member 310 so that the screw or bolt member head does not extend beyond the surface of rear body member 310. Of course, any number of screw or bolt attachment holes 228 and 328 may be provided in the remainder of the club head 102 structure and the rear body member 310 without departing from this invention. If desired, cover members (such as friction fitted plugs, flaps, etc.) may be provided (not shown) to cover any exposed or open hole or holes that may receive the screw members (or other connectors) to present a solid construction appearance and to prevent dirt or debris from entering the holes and/or the club head body interior during use. In alternative embodiments, the screw or bolt members 324 may engage the holes 228 of the remainder of the club head 102 through the holes 328 of the rear body member 310. In such embodiments, the countersink openings and/or cover members may then be a feature of the remainder of the club head 102 structure instead of the rear body member 310.

A wide variety of other ways of securing the rear body member 310 in place with respect to the remainder of the club head 102 structure are possible without departing from this invention. For example, if desired, the remainder of the club head 102 structure and/or the rear body member 310 may be provided with extending surfaces (such as detent mechanisms, spring mounted projections, ridges, etc.) that fit into corresponding and/or mating openings, slots, grooves, or the like provided in the other member. Any way of securing and releasing the rear body member 310 to the remainder of the club head 102 structure may be used without departing from this invention, including, for example: friction fits, clamps, clasps, mechanical connectors, cam structures, retaining member/groove or opening structures, spring loaded mechanisms, etc.

As illustrated in FIG. 3B, the rear body member 310 may optionally include more than one part or portion. The embodiment depicted shows a rear body member 310 that has two separate portions 310*a*, 310*b*, but any number of portions may be used without departing from the scope of this invention. As previously stated, the opening to the cavity in which the rear body members 310*a*, 310*b* are mounted may also be made up of a plurality of openings. Although some embodiments may have a one-to-one correlation of the number openings to the number of rear body member 310 portions, other embodiments may have fewer openings than rear body member 310 portions, while still other embodiments may have fewer rear body member 310 portions than openings. For example, in FIG. 3B, the opening to the cavity may comprise a single opening (separated into three portions by two support beams 230) while receiving a rear body member 310 comprising two separate portions (that optionally at least partially overlap one another, e.g., at the rear center of the club head). The ability to use varying numbers of openings and rear body member parts is advantageous in the flexibility provided for distributing weight differently according to desired golf club 100 characteristics.

Distributing weight at different places by using a rear body member 310 may allow users or club fitters to affect the flight of balls propelled using club heads 102 and golf clubs 100 in accordance with these examples of the invention. For example, it is typically easier for at least some users to get a golf ball airborne using a club head 102 having significant weight located lower and toward its rear (e.g., a rear body member 310 with the majority of its weight extending beyond the back of the club head 102 and toward the sole 102*d*). Such weight positioning also may be used to provide a higher, more lofted golf ball flight path, at least for some users. Under some play conditions and/or for some swing types, however, this higher flight bias and/or ball flight path may not be desirable. For example, to produce lower, more boring ball flights, e.g., for play in windy conditions, or for swing flaws that typically produce an excessively high, ballooning ball flight, a rear body member 310 may include a portion that extends into the interior cavity of the club head 102, such that more weight is positioned forward, toward the ball striking face.

In another possible embodiment of the invention, the surface of the rear body member 310 that is adjacent to or inserted into the rear body member receiving cavity of the club head 102 may include mating portions (e.g., projections and/or receptacles therefore) that, when the rear body member 310 is secured to the remainder of the club head 102 structure, may extend into openings located between and/or in the beams 230. Alternatively, or in addition, the rear body member 310 and/or the remainder of the club head 102 structure may include mating portions (male and/or female), which may help to securely hold the rear body member(s) 310 in place within the rear body member receiving cavity of the club head 102.

FIGS. 3A and 3C illustrate another feature provided in club head 102 structures according to at least some examples of this invention. Notably, in these example structures, the rear body member 310 or some other portion of the club head 102 structure may include a slot, groove, or opening 334 defined therein. This slot, groove, or opening 334 may be used for mounting a weight member 346, examples of which will be described in more detail below. The slot, groove, or opening 334 may be open, partially open or closed without departing from this invention.

The slot, groove, or opening 334 may take on any desired size or shape, and it may be provided at any desired position or location in the club head structure (e.g., in the sole 102*d*, in the crown 102*c*, in the rear face 102*e*, in the rear body member 310, etc.) without departing from this invention. Also, if desired, the club head 102 structure, including any individual part thereof (e.g., the rear body member 310, the sole 102*d*, etc.), may include more than one slot, groove, or opening 334 for receiving weight members 346. Also, any number of separate and individual weight members 346 may be mounted in the various slots, grooves, or openings 334 without departing from this invention (e.g., one slot, groove, or opening 334 may include any desired number of weight members 346, including zero, one, two, or more). In the example structure illustrated in FIG. 3A, the rear body member 310 includes a single slot, groove, or opening 334 that extends across a portion of the width of the rear body member 310. In the example structure illustrated in FIG. 3C, the rear body member 310 includes two vertically arranged openings 334. Additionally or alternatively, a similar slot, groove, or opening 334 may be provided at different locations in the rear body member 310 or elsewhere in the remainder of the club head 102 structure. As yet another alternative, if desired, some portion of the club head (e.g., the sole 102*d*, the rear face 102*e*, etc.) may include one or more weight ports in which one or more removable weight members 346 may be mounted (optionally, in a tight fitting or non-slidable manner). Such constructions enable users (or club fitters) to provide additional weight in different portion (s) of an overall club head 102 structure, which can be useful to provide a draw biased club, a fade biased club, and/or a club that helps compensate for swing flaws that typically produce an excessively fading or slicing ball flight or a drawing or hooking ball flight.

If desired, one or more weight members 346 may be directly engaged with the slot, groove, or opening 334 of the club head 102 structure as shown in the example illustrated in FIG. 3C. The weight member(s) 346 may be held in place in any desired manner, including in a releasable or removable manner, permanently mounted therein, etc., including through the use of mechanical connectors (e.g., screws, bolts, spring-loaded retaining elements, detents, friction fits, etc.), fusing techniques (e.g., adhesives, cements, welding, brazing, soldering, etc.), and the like. FIG. 3A, however, illustrates another possible construction that may be used in accordance with at least some examples of this invention. As shown in this example structure, a weight cartridge member 342 is mounted in the slot, groove, or opening 334 of the rear body member 310. The weight cartridge member 342 may be designed to fit flush with the remainder of the surface of the rear body member 310, extend somewhat out from the rear body member 310, or, if desired, countersunk into the rear body member 310. The weight cartridge member 342 may be made from any desired materials, including, for example, metal alloy materials, polymeric materials, etc. (e.g., any of the materials used in constructing the golf club head 102, as described above, any other material typically used in golf club construction, etc.). The weight cartridge member 342 may be secured to the rear body member 310 (and/or other portion of the club head 102 structure) in any desired manner, such as through the use of mechanical connectors, fusing techniques, or the like.

The weight cartridge member 342 of this example structure in FIG. 3A includes an open channel 344 into which one or more weight members 346 may be mounted. The weight member(s) 346 may be mounted in the channel 344 in any desired manner without departing from this invention, including using mechanical connectors (e.g., screws, turnbuckles, etc.), spring-loaded mechanisms (e.g., detents, spring-biased retaining elements fitting into openings in the channel 344 wall, etc.), other retaining members and/or retaining groove structures, and the like. Also, the channel 344 and/or weight member(s) 346 may be provided with structures so as to allow mounting at plural, discrete positions along the channel 344, or the securing mechanisms may allow mounting at any desired position(s) along the channel without departing from this invention (e.g., using various securing, locking, or anchoring structures). The weight members 346 may be made from lead, tungsten, lead-containing materials, tungsten-containing materials, and/or other heavy or dense materials. The weight members 346 may be made of other materials as well.

The weight cartridge member 342 may be secured with the rear body member 310 at any desired time in the club head manufacturing process without departing from this invention. In some embodiments, the weight cartridge member 342 is attached to the rear body member 310 before the rear body member 310 is attached to the remainder of the golf club head 102 structure. Other construction techniques are possible, such as attachment of the weight cartridge member 342 to the rear body member 310 after the rear body member 310 is engaged with the remainder of the club head 102 structure. Also, if desired, the weight cartridge member 342 need not be secured only to the rear body member 310. Also, the weight cartridge member 342 may be provided in other portions of the club head 102 structure, such as in the crown 102*c* and/or the sole 102*d*, and optionally not in the rear body member 310, without departing from this invention. Any number of weight cartridge members 342, at any desired locations in an overall club head 102 structure, may be used without departing from this invention.

With further reference to FIG. 3B, as discussed above, the rear body member may include more than one portion, e.g., first portion 310*a* and second portion 310*b*. In some arrangements, the rear body member 310 may include more than two portions, as will be discussed more fully below. The first rear body portion 310*a* and second rear body portion 310*b* shown in FIG. 3B may be formed of the same or similar materials or may be formed of different materials. The first rear body portion 310*a* and the second rear body portion 310*b* may also be formed having different weight, density, etc. characteristics. For instance, one of the first rear body portion 310*a* and the second rear body portion 310*b* may be heavier, more dense, have a different weight distribution, have a different size, have a different shape, etc. than the other.

Figure 4A:
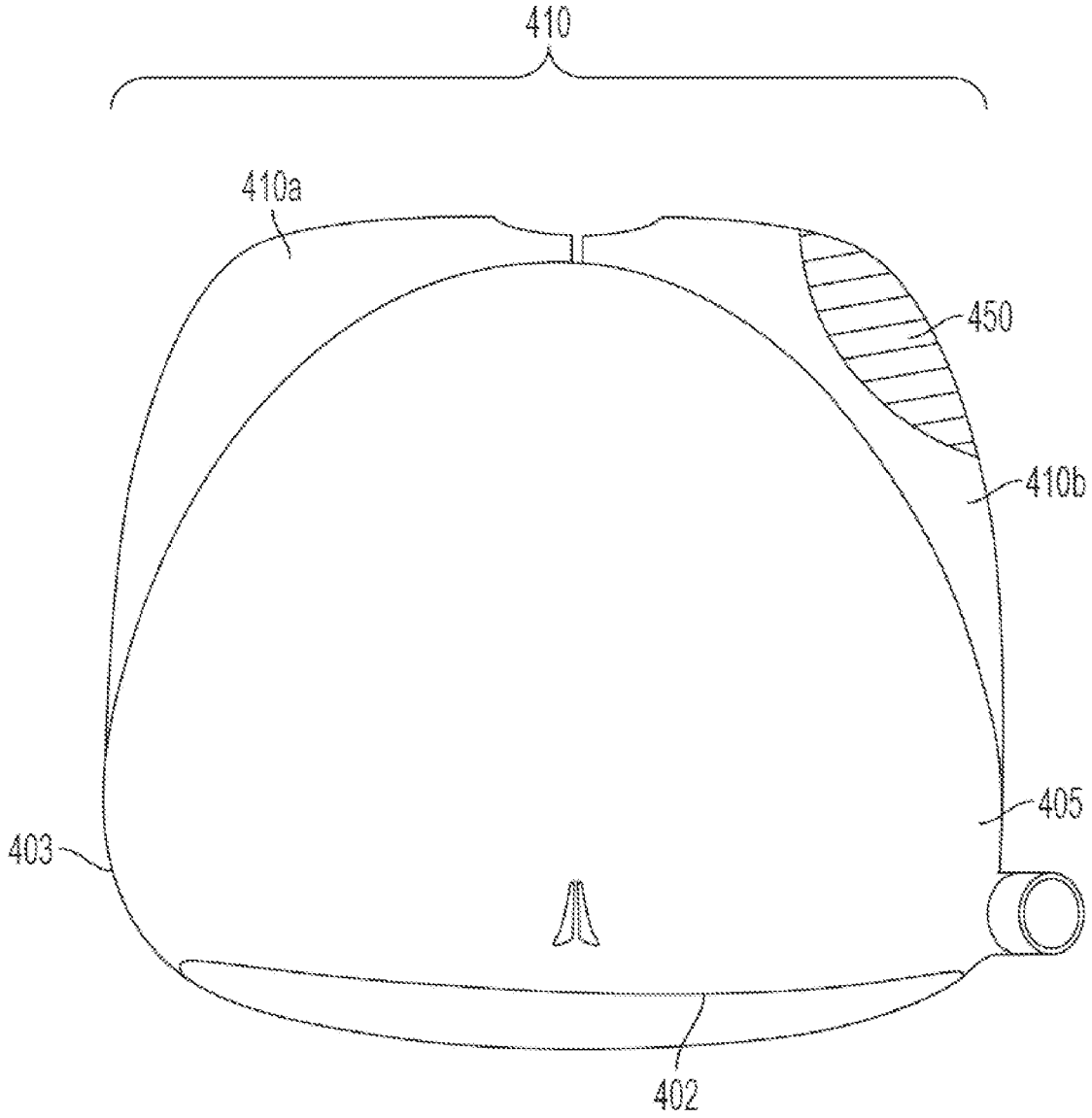
FIGS. 4A-4C illustrate various views of one example golf club head with an interchangeable rear body member having multiple rear body parts in accordance with at least some aspects of this invention.

In some arrangements, the materials, weight characteristics, etc. of the rear body member portions may be determined and/or selected based on desired performance characteristics of the golf club head. FIG. 4A illustrates a top view of one arrangement of a golf club head 402 having a multi-part interchangeable rear body member 410. In some examples, the first rear body portion 410*a* and the second rear body portion 410*b* may have equal or substantially equal weight and/or density characteristics. In other examples, the first rear body portion 410*a* may be positioned near a toe end 403 of the golf club head 402 and may be heavier or denser than the second rear body portion 410*b* positioned near the heel end 405 of the golf club head 402. This additional weight near a toe end 403 of the golf club head 402 may increase the distance from the hosel to the center of gravity of the golf club head body. Because the center of gravity is further away from the hosel, the golfer may not be able to rotate the golf club head body as quickly or easily (e.g., from an open club face position to a closed club face position). Therefore, the stability of the golf shot may be increased. Hence, such a configuration can aid a golfer in imparting "fade" trajectory to the golf ball. A "fade" is a golf shot in which, for example, for a right handed golfer, the golf ball will have "left to right" trajectory. The ball flight for a "fade" tends to have more back spin and, therefore, the ball tends to roll less once it lands. Also, "fades" tend to exhibit higher ball flights. These aspects of a "fade" (i.e., more back spin, less roll and higher ball flight) tend to stop the ball from rolling. Such a club head construction can also help compensate for swing flaws of golfers that tend to hook the ball.

Alternatively, the second rear body portion 410*b* may be heavier or more dense than the first rear body portion 410*a* to alter the performance characteristics of the golf club head 402 (i.e., affect the flight path of a ball struck with the golf club). In order to adjust the weight associated with each rear body portion 410*a*, 410*b*, the rear body parts 410*a*, 410*b* may be formed of different materials. For instance, one or more of the rear body parts 410*a*, 410*b* may be formed of a composite material, such as carbon fiber composite. In other arrangements, one or more of the rear body parts 410*a*, 410*b* may be formed of a polymer material. In still other examples, one or more of the rear body parts 410*a*, 410*b* may be formed of a polymer material and may include a powder material that may be heavier than the polymer to add additional weight to one or more rear body parts 410*a*, 410*b*. For instance, the polymer may be loaded with tungsten-containing powder or flakes to add additional weight to the rear body portion 410*a*, 410*b*. Other materials may be used to add additional weight to one or more rear body parts 410*a*, 410*b*, such as any other metallic material, including steel, lead, or any other material with a density higher than the base material (e.g., base polymer material). This loading of the polymer with a heavier material powder may be used in conjunction with an additional weight member, such as weight member 346 in FIG. 3C, or in place of an additional weight member to distribute or add additional weight to the one or more rear body parts 410*a*, 410*b*. Thus, it is understood that the rear body parts 410, 410*b* shown in FIG. 4 may be configured to accept an additional weight member such as weight member 346 in FIG. 3C. It is further understood that the respective features described in relation to other embodiments herein can be combined with other embodiments as desired.

In at least some examples, the rear body parts 410*a*, 410*b* may be formed using known molding techniques, such as injection molding, two shot molding, etc. to result in point-loading of the weight member, e.g., a weight formed in a particular area of one or more rear body parts 410*a*, 410*b*. For instance, FIG. 4A shows an additional weighted portion 450 within rear body portion 410*b*. In some examples, both (or all) rear body parts 410*a*, 410*b* may include an additional embedded or integrally formed weighted portion, while in other examples, the rear body parts 410*a*, 410*b* need not include any additional weighted portions, such as portion 450. In some arrangements, the additional weighted portion 450 may have a density between 1 g/cc and 11 g/cc. However, other density ranges are possible without departing from the invention. For instance, in one example arrangement, the rear body portion 410*a* may have a density of approximately 1 g/cc, while the additional weighted portion 450 may have a density of approximately 11 g/cc. In still other examples, one or more rear body parts 410*a*, 410*b* may be formed using a rapid prototyping additive fabrication technique, such as laser sintering, stereolithography, and the like.

Rear body parts 410*a*, 410*b* may be formed such that they are interchangeable within the golf club head 402. That is, rear body portion 410*a* may be replaced at the toe end 403 of the club head 402 with rear body portion 410*b* from the heel end 405, and vice versa. As such, the shape of the rear body parts 410*a*, 410*b* and respective connecting structures to the golf club head 402 can be configured wherein the rear body parts 410*a*, 410*b* are not required to be rotated about an axis to be interchangeable between the toe end 403 and heel end 405 or so that the portions 410*a*, 410*b* are required to be rotated in order to fit within the opening at the rear portion. In still other examples, additional rear body parts of varying weight, density, size, shape, weight distribution, etc. characteristics may be provided and may be interchanged with rear body parts 410*a* and 410*b* as desired (e.g., provided as part of a "kit" or as separately marketed items available to the consumer). In some examples, the rear body parts 410*a*, 410*b* may be between 8 and 75 grams each. However, other ranges are possible without departing from the invention. The rear body parts 410*a*, 410*b* may be connected to the golf club head 402 using various methods of connection, such as mechanical fasteners, as described in more detail above.

Figure 4B:
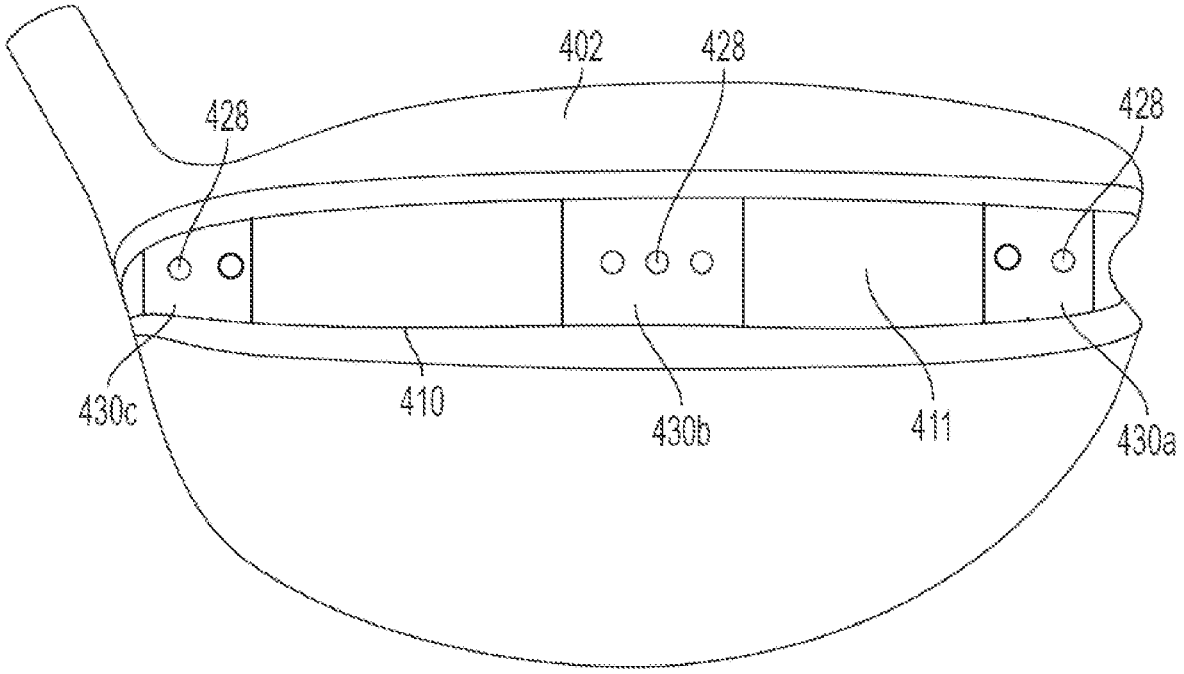

Similar to the arrangements discussed above, the golf club head 402 may define an interior cavity 411. The golf club head 402 may further include one or more openings 460 to the interior cavity 411 to which the rear body member 410 may be connected. As discussed above, the one or more openings 460 may include various connecting portions or support beams to which one or more rear body parts 410*a*, 410*b* may be connected. FIG. 4B illustrates a rear view of the golf club head 402 clearly showing the opening 460, interior cavity 411 and associated support beams 430*a*, 430*b*, 430*c*. Although three support beams are shown, more or fewer support beams may be provided without departing from the invention. The support beams 430*a*, 430*b*, 430*c* may include an aperture 428 through which a screw 424 or other fastener may extend to connect the rear body parts 410*a*, 410*b* to the golf club head 402. In some arrangements, one or more of the support beams, such as central support beam 430*b*, may include a plurality of apertures 428 that may provide adjustability in the positioning of rear body parts 410*a*, 410*b*. For instance, one rear body portion may be in an "off center" arrangement, such that the rear body parts 410*a*, 410*b* are not positioned symmetrically about the golf club head 402. This arrangement may provide additional adjustment in the weight distribution associated with the golf club head 402 and rear body parts 410*a*, 410*b*.

Figure 4C:
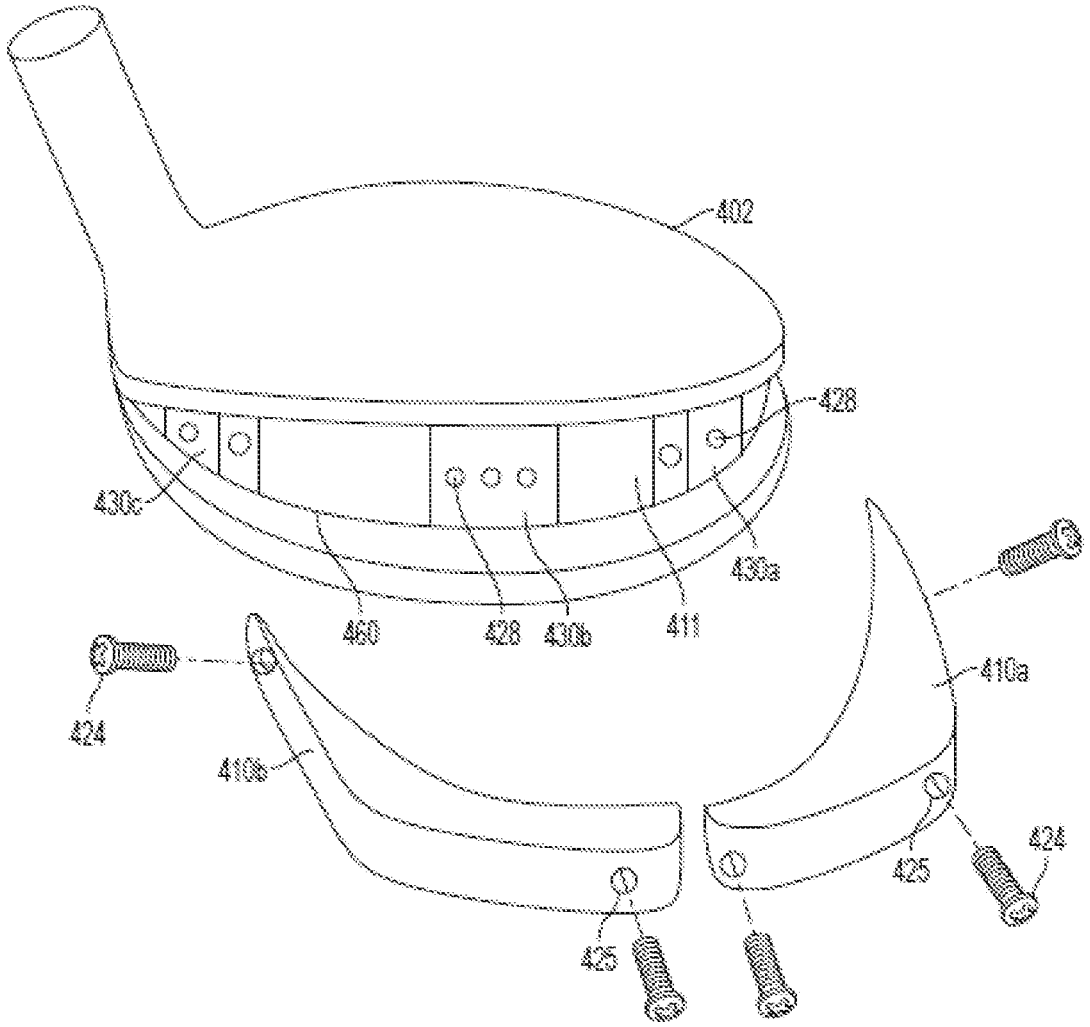

FIG. 4C is a perspective view of one arrangement of rear body parts 410*a*, 410*b* connecting to the golf club head 402. Similar to the arrangement described above with respect to FIG. 3B, screws 424 or other fasteners may be used to connect the rear body parts 410*a*, 410*b* to the golf club head 402. A plurality of apertures 425 may be formed in the rear body parts 410*a*, 410*b* and aligned with apertures 428 in support beams 430 to facilitate connection of the rear body parts 410*a*, 410*b* to the golf club head 402. In some arrangements, a portion of the rear body parts 410*a*, 410*b* may be received into the opening 410 or interior cavity 411 of the golf club head 402 in order to aid in positioning and connecting the rear body parts 410*a*, 410*b* to the golf club head 402. In some examples, the rear body parts 410*a*, 410*b* may extend into the club head interior cavity by ½ inch to 1 inch.

In some examples, different regions of each rear body portion 410*a*, 410*b* may be heavier than other regions. For instance, the first rear body portion 410*a* may be positioned near a toe edge or end 403 of the golf club head 402 and an end of the first rear body portion 410*a* most proximal the toe edge or end 403 of the golf club head 402 may be heavier or denser than an end of the first rear body portion 410*a* most distal the toe end 403 of the golf club head 402. Additionally or alternatively, the second rear body portion 410*b* may have an end most proximal the heel region or end 405 of the golf club head 402 that is heavier or denser than an end of the second rear body portion 410*b* most distal the heel region or end 405 of the golf club head 402. Other weighted region arrangements are possible. This positioning of additional weight, or distribution of the weight associated with the rear body parts 410*a*, 410*b*, to a rear edge of the golf club head 402 near a toe end 403 and a heel end 405 may aid in stabilizing the golf club head 402 to produce straighter, more stable shots.

Figure 5A:
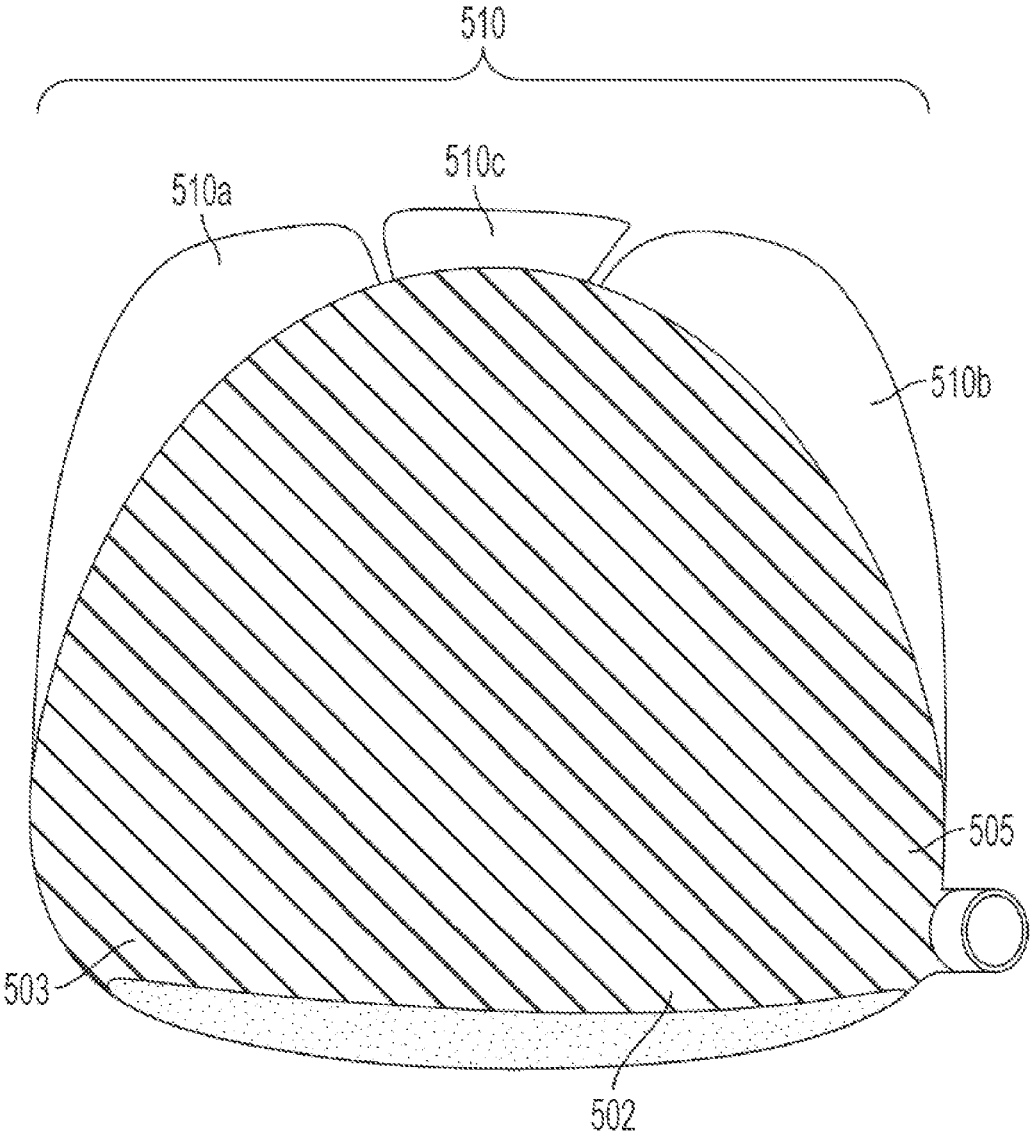
FIGS. 5A-5C illustrate various views of another example golf club head with an interchangeable rear body member having multiple rear body parts in accordance with at least some aspects of this invention.
Figure 5B:
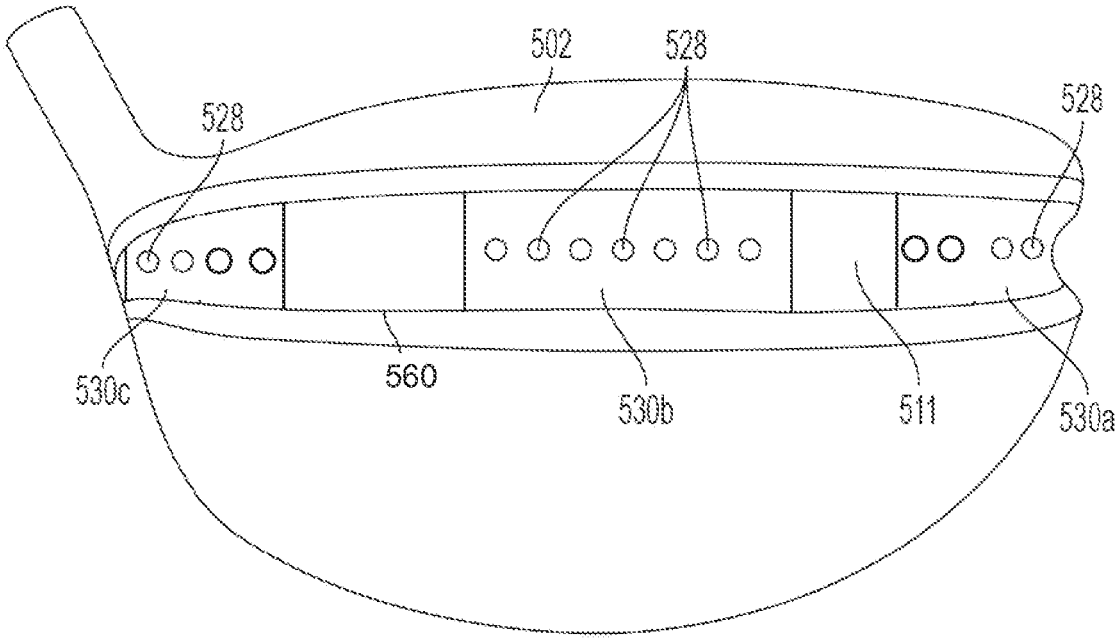
Figure 5C:
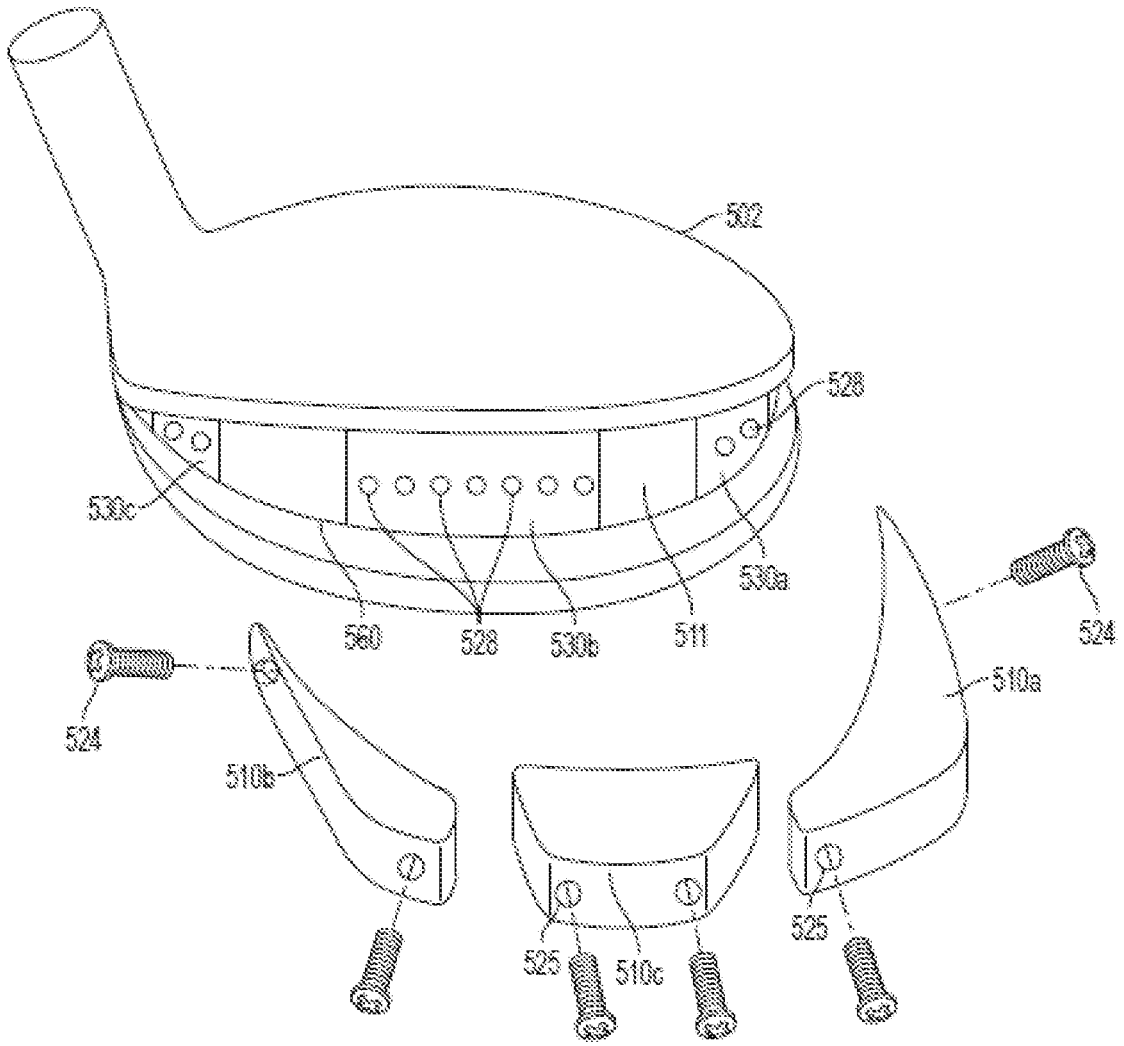

FIGS. 5A through 5C illustrate one example golf club head 502 that includes a rear body member 510 having three rear body parts 510*a*-510*c*. Although three rear body parts are shown, more or fewer rear body parts may be used without departing from the invention. The rear body parts 510*a*-510*c* permit additional flexibility in the distribution of weight associated with the golf club head 502. For example, in one arrangement, a user may have a first rear body portion 510*a* near a toe region 503 of the golf club head 502, a second rear body portion 510*b* near a heel region 505 of the golf club head 502, and a third rear body portion 510*c* positioned near a center of the rear of the golf club head 502 (i.e., between first rear body portion 510*a* and second rear body portion 510*b*). In some examples, the first rear body member 510*a* and second rear body member 510*b* may be of equal or substantially equal weight while the third rear body member is of a different weight that may be less than the weight of the first and second rear body parts 510*a*, 510*b*. This arrangement may aid in distributing weight associated with the rear body parts to the rear corners of the golf club head to provide improved golf club performance.

In other arrangements, the first and second rear body parts 510*a*, 510*b* may be of equal or substantially equal weight which may be less than the weight associated with the third rear body portion 510*c* in order to concentrate a portion of the weight in a central portion of the rear of the golf club head 502. In still other arrangements, the three rear body parts 510*a*-510*c* may each be of different weights and/or weight distributions. Other examples may include the first rear body portion 510*a* and third rear body portion 510*b* each having a weight or density greater than the second rear body portion 510*b* in order to distribute a greater portion of the weight associated with the rear body member 510 near a toe end 503 of the golf club head 502.

Various other weight, weight distribution, density, size, shape, and other characteristics of the rear body parts 510*a*-510*c* may be used in conjunction with the arrangements describes herein without departing from the invention. Additionally, or alternatively, the size or length of the rear body parts 510*a*-510*c* may vary. For instance, the length of the third rear body portion 510*c* may be longer or shorter than illustrated in FIG. 5A-5C. Accordingly, the length and/or size of the first rear body portion 510*a* and second rear body portion 510*b* may be longer or shorter to accommodate the different size of the third rear body portion 510*c*. In other arrangements, only one of the first rear body portion 510*a* and second rear body portion 510*b* may be adjusted for size in order to provide an off-center or asymmetric rear body member arrangement. For instance, the first rear body member 510*a* may be similar to the size shown in FIGS. 5A-5C, the third rear body member 510*c* may be longer than illustrated and may be positioned to extend beyond a center of the rear of the golf club head 502. The second rear body portion 510*b* may then be shorter than illustrated in order to accommodate the increased size or length of the third rear body portion 510*c*. These are just a few examples of some size variation arrangements. Various other size, length, etc. combinations, adjustments, and the like may be considered without departing from the invention.

Similar to the arrangements discussed above, golf club head 502 may further include one or more openings 560 to an interior cavity 511 defined by the golf club head 502. The one or more openings 560 may include one or more connecting portions or support beams to which one or more of rear body parts 510*a*-510*c* may be connected. FIG. 5B illustrates a rear view of the golf club head 502 depicting the one or more openings 560, interior cavity 511 and associated support beams. Although three support beams 530*a*, 530*b*, 530*c* are shown, more or fewer support beams may be provided without departing from the invention. The support beams 530*a*, 530*b*, 530*c* may include an aperture 528 through which a screw 524 or other fastener may extend to connect the rear body parts 510*a*-510*c* to the golf club head 502. In some arrangements, one or more support beam 530*a*, 530*b*, 530*c* may include a plurality of apertures 528 to provide additional adjustability in the position of the rear body parts 510*a*-510*c*. For instance, central support beam 530*b* may include a plurality of apertures to which the third rear body portion 510*c* may connect. The plurality of apertures may aid in permitting the third rear body portion 510*c* to be positioned in a center of the rear of the golf club head 502 or off center, as desired. This may provide additional weight to toe end or heel end of the golf club head 502 in order to provide varying performance characteristics.

FIG. 5C is a perspective view of one arrangement of rear body parts 510*a*-510*c* connecting to the golf club head 502. Similar to the arrangement described above with respect to FIG. 3B, screws 524 or other fasteners may be used to connect the rear body parts 510*a*-510*b* to the golf club head 502. A plurality of apertures 525 may be formed in the rear body parts 510*a*-510*c* and aligned with apertures 528 in support beams 530*a*, 530*b*, 530*c* to facilitate connection of the rear body parts 510*a*-510*c* to the golf club head 502. The plurality of apertures shown in support beams 530*a*, 530*b*, 530*c* permit alignment of apertures 525 with various apertures 528 in the support beams 530 in order to adjust the position of one or more rear body parts 510*a*-510*c*. In some arrangements, a portion of the rear body parts 510*a*-510*c* may be received into the opening 560 or interior cavity 511 of the golf club head 502 in order to aid in positioning and connecting the rear body parts 510*a*-510*c* to the golf club head 502.

Some example golf club heads according to aspects described herein may include rear body member(s) having multiple rear body parts that extend beyond the perimeter of the golf club head. For instance, as shown in FIG. 4*a* through SC, the golf club head 402, 502 defines a footprint. In some arrangements, the footprint may include the peripheral edges of the overall golf club head. In other examples, the footprint may include a rear end of a golf club head. The rear body member 410, 510 extends beyond the perimeter of the golf club head 402, 502 to extend the footprint of the overall golf club head. The connection of the rear body members 410, 510 to the rear of the golf club head 402, 502 aids in distributing more weight associated with the golf club head to the rear of the golf club head.

Further, the rear body member may alter the overall shape, size, etc. of the golf club head. For instance, as shown in FIGS. 4A through SC, the golf club head 402, 502 may have a conventional shape (i.e., may be substantially rounded) when viewed without the addition of the rear body member 410, 510. Connection of the rear body member 410, 510 may then alter the shape of the golf club head 402, 502 to a generally square shaped overall golf club head. Altering the shape of the golf club head 402, 502 from a round head to a square head may aid in distributing more weight toward the rear of the golf club head 402, 502 thereby affecting the center of gravity and moment of inertia of the golf club head. For example, the additional members may allow for improved perimeter weighting. Alternatively, a generally square shaped golf club head may have a rear body member that may transform the shape to a more conventional, generally rounded golf club head shape. This type of shape change may alter the spin rate of a golf ball as launched. For instance, moving the center of gravity forward (as would occur with a round club as compared to a square club) would tend to make the ball spin less off the driver. Various other size, shape, etc. modifications may be made by connecting various rear body members without departing from the invention.

Figure 6:
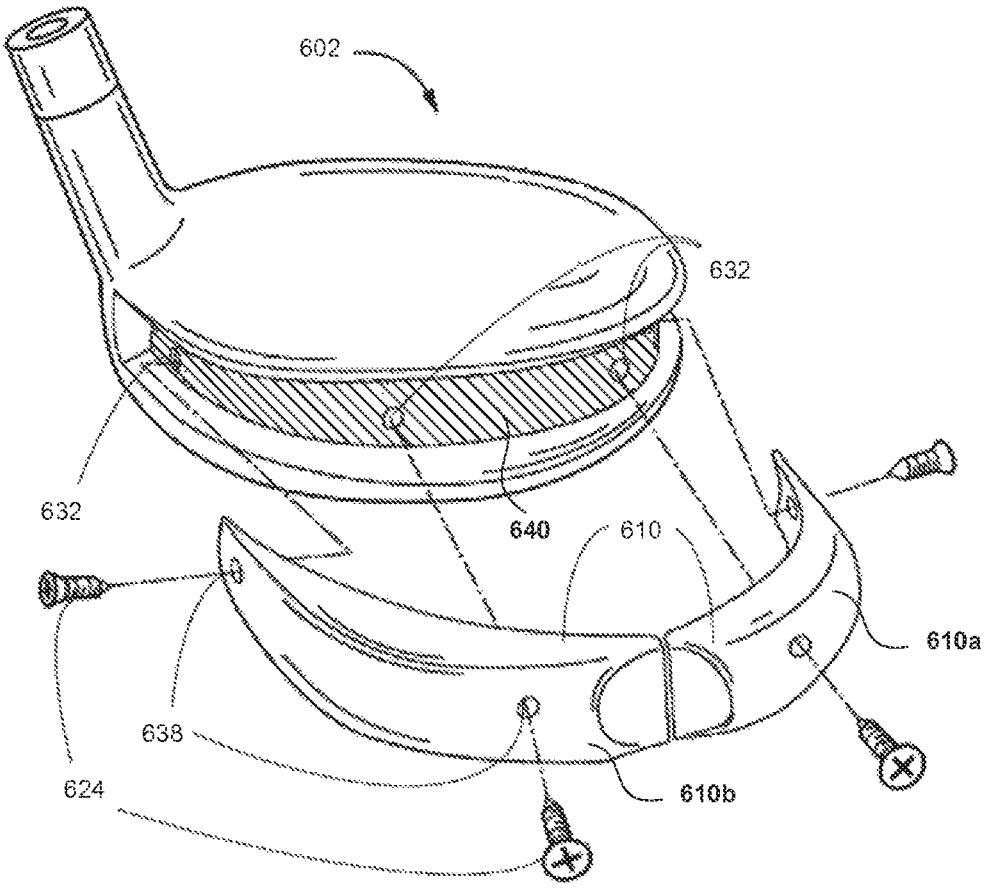
FIG. 6 illustrates another example golf club head structure in accordance with at least some aspects of this invention.

FIG. 6 illustrates another example golf club head that includes two rear body parts 610*a*, 610*b*. The golf club head 602 is similar to the golf club head 102 shown in FIG. 3B. The interior of the golf club head 602 is not exposed and instead a solid portion or wall 640 is shown. The wall 640 may prevent dirt, debris, etc. from accessing the interior of the golf club head 602. In addition, the wall 640 may include one or more apertures or other structures 632 configured to aid in connecting the rear body parts 610*a*, 610*b* to the golf club head. For instance, the apertures 632 may align with one or more apertures 638 in the rear body parts 610*a*, 610*b* through which a screw, bolt or other fastener, such as fastener 624 may extend to connect the rear body parts 610*a*, 610*b* to the golf club head 602. In other examples, more or fewer apertures may be provided to connect the rear body parts 610*a*, 610*b* to the golf club head 602. In still other examples, other means of fastening the rear body parts 610*a*, 610*b* to the golf club head 602 may be used, such as adhesives, snap fits, and the like.

While various structures and techniques are described above (e.g., rear body members with different weight distributions mounted to the remainder of the golf club head structure in various ways) in conjunction with various specific structures shown in FIGS. 1A through 6, features and aspects of this invention may be applied to a wide variety of club head structures or constructions without departing from the invention. For example, a wide variety of constructions, numbers of parts, combinations of materials, and the like may be used, including constructions, parts, and combinations of materials that are known and used in the art. More specific examples of additional potential club head constructions that may include weight attaching structures and/or weighting techniques of the types described above include, but are not limited to: two piece club constructions, e.g., of metallic or metal alloy materials, polymer-containing materials, or composite-containing materials, either as a solid material or a having a hollow interior chamber within the club head, including a main body and a separable rear body member; constructions having a face member (e.g., a face frame member with a face plate attached thereto or integrally formed therewith) with an aft body attached thereto (the aft body may be constructed from one or more of metallic or metal alloy materials, polymer-containing materials, or composite-containing materials, either as a solid material or a having a hollowed out interior chamber) and a rear body member attached to the aft body; multi-piece constructions, e.g., constructions having a face member (e.g., a face frame member with a face plate attached thereto or integrally formed therewith) with a multi-piece body attached thereto (the body may be constructed from one or more of metallic or metal alloy materials, polymer-containing materials, or composite-containing materials, e.g., including one or more of a crown member, a sole member, one or more body members, etc) including a rear body member; etc. A wide variety of other constructions also are possible.

Weight adjustable golf club heads of the types described above may be used by golfers, on the golf course, for their regular play (users can maintain the ability to modify the weight settings and/or customize the club head to their swing characteristics). As another example, however, golf club heads in accordance with at least some examples of this invention (e.g., of the types described above) also may be useful for club fitting purposes. For example, by providing club heads with different rear body members of the types described above, club fitters and/or users can quickly adjust the playing characteristics of a club head by adjusting or interchanging the rear body members used and/or provided with the club head. In this manner, a user being fit for new clubs and/or club components can quickly try different weighting characteristics for the club head using a single club head (as opposed to the club fitter having to carry a large inventory of club heads each with slightly different weighting characteristics). Then, when a weight arrangement and/or orientation is found that best suits a user's swing characteristics and/or provides a desired ball flight path, based on the adjustable club head's settings (e.g., the position and amount of the weight within the rear body member that produces the best characteristics for that user), the club fitter can order or build a club head for the user having permanent weighting characteristics based on and derived from the club head construction and removable rear body member used during the fitting session(s).

III. CONCLUSION

The present invention is described above and in the accompanying drawings with reference to a variety of example structures, features, elements, and combinations of structures, features, and elements. The purpose served by the disclosure, however, is to provide examples of the various features and concepts related to the invention, not to limit the scope of the invention. One skilled in the relevant art will recognize that numerous variations and modifications may be made to the embodiments described above without departing from the scope of the present invention, as defined by the appended claims. For example, the various features and concepts described above in conjunction with FIGS. 1A through 6 may be used individually and/or in any combination or subcombination without departing from this invention.

What is claimed is:

1. A golf club head comprising:

a club head body made from one or more parts, the club head body including a heel portion, a toe portion, a top portion, a sole portion, and a striking face, wherein the club head body defines an interior cavity and further defines an opening to the interior cavity, wherein the opening is located in a rear portion of the club head body away from the striking face and is defined by an upper surface adjacent the top portion and a lower surface adjacent the sole portion;

a first rear body portion removably engageable with the club head body and configured to at least partially cover the opening into the interior cavity;

a second rear body portion removably engageable with the club head body and configured to at least partially cover the opening into the interior cavity;

wherein the second rear body portion is heavier than the first rear body portion; and wherein the second rear body portion comprises a weight member;

wherein the first rear body portion and the second rear body portion are interchangeable to the toe portion and the heel portion.

2. The golf club head of claim 1, wherein the weight member is embedded within the second rear body portion.

3. The golf club head of claim 1, wherein the first rear body portion and the second rear body portion are made of different materials.

4. The golf club head of claim 1, wherein at least one of the first rear body portion and the second rear body portion are made from a material selected from the group consisting of a metallic material, a composite material, and a polymeric material.

5. The golf club head of claim 1, wherein at least some portion of the club head is formed from carbon fiber composite material.

6. A golf club head comprising:

a club head body made from one or more parts, the club head body including a heel portion, a toe portion, a top portion, a sole portion, and a striking face, wherein the club head body defines an interior cavity and further defines an opening to the interior cavity, wherein the opening is located in a rear portion of the club head body away from the striking face and is defined by an upper surface adjacent the top portion and a lower surface adjacent the sole portion;

a first rear body portion removably engageable with the club head body and configured to at least partially cover the opening into the interior cavity;

a second rear body portion removably engageable with the club head body and configured to at least partially cover the opening into the interior cavity;

wherein the second rear body portion is heavier than the first rear body portion; and wherein at least one of the first rear body portion and the rear second body portion comprises a weight cartridge member configured to accept an additional weight member.

7. The golf club head of claim 6, wherein the weight cartridge member includes an open channel into which the additional weight member is mounted.

8. The golf club head of claim 6, wherein the weight cartridge member comprises one or more structures configured to mount the additional weight member at plural, discrete positions along a channel.

9. The golf club head of claim 6, wherein the additional weight member is releasably mounted within a channel by a mechanical connector.

10. The golf club head of claim 6, wherein the additional weight member has a density between 1 g/cc and 11 g/cc.

11. The golf club head of claim 6, wherein the additional weight member is made from lead, tungsten, a lead-containing material, or a tungsten-containing material.

12. The golf club head of claim 6, wherein at least one of the first rear body portion and the second rear body portion are formed of a composite material.

13. The golf club head of claim 12, wherein the composite material is a carbon fiber composite material.

14. The golf club head of claim 6, wherein at least some portion of the club head is formed from carbon fiber composite material.

* * * * *